US006749083B2

(12) United States Patent
Sosalla et al.

(10) Patent No.: US 6,749,083 B2
(45) Date of Patent: Jun. 15, 2004

(54) STACK OF FAN FOLDED MATERIAL AND COMBINATIONS THEREOF

(75) Inventors: Gerald Keith Sosalla, Appleton, WI (US); Yung Hsaing Huang, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/436,731

(22) Filed: May 12, 2003

(65) Prior Publication Data

US 2003/0192902 A1 Oct. 16, 2003

Related U.S. Application Data

(62) Division of application No. 09/871,020, filed on May 31, 2001, now Pat. No. 6,612,462.

(51) Int. Cl.[7] ..... A47K 10/24

(52) U.S. Cl. ..... 221/45; 206/449

(58) Field of Search ..... 221/45, 48, 49, 221/303, 61, 83; 206/449, 494, 554

(56) References Cited

U.S. PATENT DOCUMENTS

| | | | |
|---|---|---|---|
| RE12,204 | E | 3/1904 | Casterline |
| 2,004,614 | A | 6/1935 | Meagher |
| 2,118,380 | A | 5/1938 | Gresenz |
| 2,323,395 | A | 7/1943 | Harwood |
| 2,529,853 | A | 11/1950 | Taggart |
| 2,626,145 | A | 1/1953 | Sabee |
| 2,642,279 | A | 6/1953 | Teall |
| 2,761,677 | A | 9/1956 | Rutkus et al. |
| 2,809,082 | A | 10/1957 | Marcuse |
| 2,823,089 | A | 2/1958 | De Franco |
| 2,890,791 | A | 6/1959 | Wenzel |
| 3,007,605 | A | 11/1961 | Donovan |
| 3,021,002 | A | 2/1962 | Guyer |
| 3,095,991 | A | 7/1963 | Paniagua |
| 3,160,337 | A | 12/1964 | Nelson |
| 3,161,336 | A | 12/1964 | Loescher |
| 3,172,563 | A | 3/1965 | Harwood |
| 3,199,861 | A | 8/1965 | Presnell et al. |
| 3,239,097 | A | 3/1966 | Bates |
| 3,266,666 | A | 8/1966 | Nelson |
| 3,291,479 | A | 12/1966 | Greiner et al. |
| 3,307,844 | A | 3/1967 | Stults |

(List continued on next page.)

FOREIGN PATENT DOCUMENTS

| | | |
|---|---|---|
| CA | 996515 | 9/1976 |
| EP | 0 223 262 A2 | 5/1987 |
| EP | 0 068 722 B1 | 4/1988 |
| EP | 0 331 027 B1 | 1/1992 |
| EP | 0 744 357 A1 | 11/1996 |
| EP | 0 644 130 B1 | 5/1998 |

(List continued on next page.)

OTHER PUBLICATIONS

American Society for Testing Materials (ASTM) Designation: D 412–98a, "Standard Test Methods for Vulcanized Rubber and Thermoplastic Elastomers—Tension," pp. 43–55, published Aug. 1998.

American Society for Testing Materials (ASTM) Designation: D 790–99, "Standard Test Methods for Flexural Properties of Unreinforced and Reinforced Plastics and Electrical Insulating Materials", pp. 150–158, published Feb. 2000.

(List continued on next page.)

*Primary Examiner*—Kenneth W. Noland
(74) *Attorney, Agent, or Firm*—Michael J. Bendel

(57) ABSTRACT

The invention relates to a stack of fan folded material and related systems and processes. The stack includes at least two clips of fan folded material. Each clip includes a plurality of fan folded sheets, with each sheet joined to at least one adjacent sheet by a weakened line. Each clip is joined to an adjacent clip by a last sheet of one clip being separably joined to a first sheet of a succeeding clip.

17 Claims, 18 Drawing Sheets

U.S. PATENT DOCUMENTS 3,369,699 A 2/1968 Enloe et al.
3,401,928 A 9/1968 Frick
3,490,645 A 1/1970 Glass et al.
3,518,810 A 7/1970 Steeves
3,576,243 A 4/1971 Trunick
3,679,094 A 7/1972 Nissen et al.
3,679,095 A 7/1972 Nissen et al.
3,700,138 A 10/1972 Nelson
3,749,296 A 7/1973 Harrison
3,780,908 A 12/1973 Fitzpatrick et al.
3,795,355 A 3/1974 Gerstein
3,803,798 A 4/1974 Clancy
3,836,044 A 9/1974 Tilp et al.
3,843,017 A 10/1974 Harrison
3,868,052 A 2/1975 Rockefeller
3,881,632 A 5/1975 Early et al.
3,973,695 A 8/1976 Ames
3,979,019 A 9/1976 Bliss
3,994,417 A 11/1976 Boedecker
4,002,264 A 1/1977 Marchesani
4,004,687 A 1/1977 Boone
4,009,682 A 3/1977 Patel et al.
4,017,002 A 4/1977 Doyle et al.
4,064,880 A 12/1977 Logan
4,100,324 A 7/1978 Anderson et al.
4,133,457 A 1/1979 Klassen
4,180,160 A 12/1979 Ogawa et al.
4,200,200 A 4/1980 Hein, III et al.
4,219,129 A 8/1980 Sedgwick
4,244,493 A 1/1981 Harrison
4,262,816 A 4/1981 Margulies
4,289,262 A 9/1981 Finkelstein
4,328,655 A 5/1982 Spencer et al.
4,328,907 A 5/1982 Beard
4,337,876 A 7/1982 Thompson
4,416,392 A 11/1983 Smith
4,458,810 A 7/1984 Mahoney
4,534,491 A 8/1985 Norton et al.
4,570,518 A 2/1986 Burmeister et al.
4,574,952 A 3/1986 Masui
4,611,728 A 9/1986 Compton et al.
4,623,074 A 11/1986 Dearwester
4,653,666 A 3/1987 Mertens
4,674,634 A 6/1987 Wilson
4,681,240 A 7/1987 Wyant
4,700,939 A 10/1987 Hathaway
4,721,295 A 1/1988 Hathaway
4,768,810 A 9/1988 Mertens
4,776,649 A 10/1988 ten Wolde
4,781,306 A 11/1988 Smith
4,784,290 A 11/1988 Howard
4,786,810 A 11/1988 Shulman et al.
4,848,575 A 7/1989 Nakamura et al.
4,854,984 A 8/1989 Ball et al.
4,859,518 A 8/1989 Schutz
4,863,064 A 9/1989 Dailey, III
4,888,229 A 12/1989 Paley et al.
4,895,746 A 1/1990 Mertens
4,921,127 A 5/1990 Windorski
4,927,064 A 5/1990 Burgin
4,952,432 A 8/1990 Ten Wolde
4,986,440 A 1/1991 Windorski
4,993,590 A 2/1991 Windorski
5,033,620 A 7/1991 De Luca
5,050,909 A 9/1991 Mertens et al.
5,067,628 A 11/1991 Evenson
5,069,735 A 12/1991 Reynolds
5,076,424 A 12/1991 Nakamura
5,080,254 A 1/1992 Feer
5,080,255 A 1/1992 Windorski
5,118,554 A 6/1992 Chan et al.
5,152,121 A 10/1992 Nakamura
5,158,205 A 10/1992 Bodziak et al.
5,165,570 A 11/1992 Windorski et al.
5,167,346 A 12/1992 Bodziak
5,225,649 A 7/1993 Andreoli et al.
5,316,177 A 5/1994 Boldt
5,332,118 A 7/1994 Muckenfuhs
5,350,597 A 9/1994 Pelley
5,358,140 A 10/1994 Pellegrino
5,379,897 A 1/1995 Muckenfuhs et al.
5,497,903 A 3/1996 Yoneyama
5,516,001 A 5/1996 Muckenfuhs et al.
5,520,308 A 5/1996 Berg, Jr. et al.
5,542,567 A 8/1996 Julius
5,542,568 A 8/1996 Julius
5,605,731 A 2/1997 Guasch Pubill
5,642,835 A 7/1997 Young et al.
5,647,506 A 7/1997 Julius
5,704,471 A 1/1998 Yamada
5,729,955 A 3/1998 Yamada
D395,952 S 7/1998 Buczwinski et al.
5,785,179 A 7/1998 Buczwinski et al.
5,810,200 A 9/1998 Trokhan
5,908,138 A 6/1999 Vlahakis et al.
D414,637 S 10/1999 Amundson et al.
6,053,357 A 4/2000 Yoh
6,082,663 A 7/2000 Tramontina et al.
6,152,322 A 11/2000 Marino
6,182,858 B1 2/2001 Hartog
6,286,712 B1 9/2001 Craig et al.
6,523,690 B1 2/2003 Buck et al.
6,550,633 B2 4/2003 Huang et al.
6,585,131 B2 7/2003 Huang et al.
6,612,462 B2 * 9/2003 Sosalla et al. ..... 221/48
2002/0096534 A1 7/2002 Amundson et al.
2002/0127937 A1 9/2002 Lange et al.
2002/0179626 A1 12/2002 Huang et al.
2002/0195764 A1 12/2002 Sosalla
2003/0010789 A1 1/2003 Sosalla et al.
2003/0022781 A1 1/2003 Sosalla et al.

FOREIGN PATENT DOCUMENTS

EP 1 023 863 A1 8/2000
GB 793745 4/1956
WO WO 99/24551 A1 5/1999
WO WO 99/55599 11/1999
WO WO 00/44270 8/2000
WO WO 00/65972 A1 11/2000
WO WO 01/74687 A1 10/2001
WO WO 02/053365 A2 7/2002
WO WO 02/058524 A2 8/2002

OTHER PUBLICATIONS

American Society for Testing Materials (ASTM) Designation: D 2240–97, "Standard Test Method for Rubber Property—Durometer Hardness," pp. 400–403, published Mar. 1997.

American Society of Testing Materials (ASTM) Designation: D 6125–97, "Standard Test Method for Bending Resistance of Paper and Paperboard (Gurley Type Tester)," pp. 885–889, published Feb. 1998.

* cited by examiner

STACK OF FAN FOLDED MATERIAL AND COMBINATIONS THEREOF

This application is a divisional of application Ser. No. 09/871,020, entitled STACK OF FAN FOLDED MATERIAL AND COMBINATIONS THEREOF, filed on May 31, 2001 now U.S. Pat. No. 6,612,462. The entirety of application Ser. No. 09/871,020 is hereby incorporated by reference.

BACKGROUND OF THE INVENTION

Wiping sheets or wipes have been made from a variety of materials which can be dry or wet when used. Wipes can be moistened with a variety of suitable wiping solutions, and are then usually referred to as wet wipes. Typically, wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. In yet other configurations, the wipes have been placed in the container in the form of a continuous web of material of similarly weakened line connected sheets from the first sheet to the last which includes perforations to separate the individual wipes and which wipes can be stacked on top of each in a fan folded manner or wound into a roll. Such wipes and wet wipes have been used for baby wipes, hand wipes, household cleaning wipes, industrial wipes and the like.

The conventional packages which contain wipes, such as those described above, have typically been designed to be positioned on a flat surface such as a countertop, changing table or the like. Such conventional packages have generally provided a plastic container, tub or package which provides a sealed environment for the sheets or wipes to ensure that they do not get contaminated by the environment surrounding the container or become overly dry in the case of wet wipes. Some of the conventional packages have also been configured to provide one at a time dispensing of each wipe which can be accomplished using a single hand after the package has been opened. Such single handed, one at a time dispensing, often referred to as "pop-up" dispensing, is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a wet wipe to clean the infant.

However, the dispensing of wipes from such conventional containers for wipes has not been completely satisfactory. For example, this is due at least in part to the configuration of the wipes within the container. In particular, for example, this concerns the relationship of each wipe in the container to each adjacent wipe in the container, such as a stack of wipes. As another example, this can concern the relationship of a group of wipes in the stack to other wipes in the stack if groups of wipes make up the stack of wipes. As yet another example, these relationships between wipes concern, in conjunction with the wipes, the container from which the wipes are dispensed and characteristics thereof.

SUMMARY OF THE INVENTION

In response to the difficulties and problems discussed above, for example, a new relationship between two adjacent sheets or wipes, as well as between groups of sheets, enabling improved dispensing, and which may be more cost effective and reliable (e.g., reducing the likelihood of wipe fallback and/or reducing the likelihood of multiple wipes dispensing undesirably), has been discovered. For example, dispensing can be improved or made easier when a wipe is ready for dispensing upon the opening of a resealable wipes dispenser after the initial opening of the dispenser and use of a first wipe in a plurality of wipes. That is, a portion of the wipe is positioned in an orifice of the dispenser sufficiently protruding so a user can readily grasp the same and remove the entire individual wipe without premature tearing or non-dispensing of the top wipe. As another example, "wipe fallback" can occur when a leading wipe in a plurality of wipes separates completely from a following or trailing wipe prematurely, i.e., before a sufficient portion of the following wipe is positioned within the dispenser orifice to remain there for later dispensing after the leading wipe is fully separated or disjointed from the trailing wipe outside the dispenser. In such a fallback situation, the following wipe would need to be re-threaded through the dispensing orifice when its dispensing is next desired. This may not be undesirable if done intentionally, i.e., if maintaining a maximum moisture level for the sheets is desired, e.g., for wet wipes, and if the dispensing orifice is designed to easily accommodate reach-in retrieval of the next sheet. As yet another example, "multiple wipes" dispensing can occur when a leading individual wipe in a plurality of wipes does not timely separate completely from a following individual wipe while the following wipe is still at least partially maintained in the dispensing orifice, i.e., the following wipe dispenses completely out of the dispenser with the leading wipe causing two (or more) wipes to dispense substantially simultaneously. This can be desirable when two (or more) wipes are needed, but if only one is desired, then this is not preferred.

The purposes and features of the present invention will be set forth in and are apparent from the description that follows, as well as will be learned by practice of the invention. Additional features of the invention will be realized and attained by the product and processes particularly pointed out in the written description and claims hereof, as well as from the appended drawings.

In one aspect, the invention provides a stack of fan folded material. The stack includes at least two clips of fan folded material. Each clip includes a plurality of fan folded sheets, with each sheet joined to at least one adjacent sheet by a weakened line. Each clip is joined to an adjacent clip by a last sheet of one clip being separably joined to a first sheet of a succeeding clip.

In another aspect, the invention provides a stack of fan folded material. The stack includes at least two clips of fan folded material. Each clip includes a plurality of fan folded sheets which can be folded along a machine direction of the sheets, with each sheet joined to at least one adjacent sheet by a weakened line which can also be formed in the machine direction of the sheets. Each clip is joined to an adjacent clip by a last sheet of one clip being adhesively joined to a first sheet of a succeeding clip.

In other aspects, the invention provides a process for forming a stack of fan folded material. This can include various steps and in various orders or as follows: providing an elongate web of material; weakening the elongate web of material along a plurality of lines to form a plurality of panels joined to adjacent panels along the plurality of lines; folding the plurality of panels together; cuffing the plurality of panels to form a plurality of clips; and joining each clip to an adjacent clip by separably joining a bottom portion of one clip to a top portion of a succeeding clip.

In still other aspects, the invention provides a stack of fan folded material. The stack includes at least two clips of fan folded material. Each clip includes a plurality of fan folded sheets, with each sheet joined to at least one adjacent sheet by a weakened line. Each clip is joined to an adjacent clip by a sheet of one clip being separably joined to a different sheet of a succeeding clip.

In yet other aspects, the invention provides a dispensing system for fan folded material. The system includes a dispenser having a base and a top enclosing an interior. A stack of fan folded material can be stored in the interior, with the top including an opening through which the fan folded material can pass to an external position outside the dispenser. The stack of fan folded material includes at least two clips of fan folded material. Each clip includes a plurality of fan folded sheets, with each sheet joined to at least one adjacent sheet by a weakened line. Each clip is joined to an adjacent clip by a last sheet of one clip being separably joined to a first sheet of a succeeding clip.

In still other aspects, the invention provides a dispensing system for fan folded material. The system includes a dispenser including a base and a top enclosing an interior. A stack of fan folded material is stored in the interior, with the top including an opening through which the fan folded material can pass to an external position outside the dispenser. The stack of fan folded material includes at least two clips of fan folded material. Each clip includes a plurality of fan folded sheets, with each sheet joined to at least one adjacent sheet by a weakened line. Each clip is joined to an adjacent clip by a sheet of one clip being separably joined to a different sheet of a succeeding clip.

In still further aspects, the invention provides a process for dispensing a stack of fan folded material from a dispenser. This can include various steps and in various orders or as follows: pulling a first sheet of the material through an opening of the dispenser; separating the first sheet from a subsequent adjacent second sheet of the material at a weakened line between the first and second sheets; pulling a subsequent third sheet of the material through the opening of the dispenser; and separating the subsequent third sheet of the material from a subsequent adjacent fourth sheet of the material at a separably joined interface between the third and fourth sheets, wherein the separably joined interface between the third and fourth sheets is a different type of separably joined interface from the weakened line between the first and second sheets.

In yet further aspects, the invention provides a process for dispensing a stack of fan folded material from a dispenser. This can include various steps and in various orders or as follows: pulling a first sheet of the material through an opening of the dispenser; separating the first sheet from a subsequent adjacent second sheet of the material at a first type of separably joined interface between the first and second sheets; pulling a subsequent third sheet of the material through the opening of the dispenser; and separating the subsequent third sheet of the material from a subsequent adjacent fourth sheet of the material at a second type of separably joined interface between the third and fourth sheets wherein the second type of separably joined interface is a different type of separably joined interface from the first type of separably joined interface.

In yet other aspects, the invention provides various configurations for the weakened line, the wipes per se, and the wipes relative to other wipes such as in a stack of wipes.

In still other aspects, the invention is provided for use in various types of dispensers and for dispensing in various manners such as reach-in dispensing and pop-up dispensing.

As used herein, the term "machine direction" or MD means the length of a fabric or material in the direction in which it is being converted. The term "cross machine direction" or CD means the width of fabric, i.e. a direction generally perpendicular to the MD.

As used herein, sheets of the invention are considered "separably joined", "separably joining" (and variations thereof when each sheet of a plurality, e.g., in a stack of sheets, is engaging any adjacent sheet while in the dispenser or package such that withdrawing the leading sheet through the dispenser or package opening also withdraws at least a portion of the following sheet through the opening before the leading sheet and the following sheet separate completely from each other. Such engaging of any adjacent sheet can include a non-interfolded relationship in combination with one or more of the following between adjacent sheets: adhesive, friction, cohesion, fusion bonding (e.g., ultrasonic welding, heat sealing), mechanical entanglement (e.g., needle punching, steam sealing, embossing, crimping), autogeneous bonding, and/or weakened line(s) (e.g., perforations, zones of frangibility, score line(s), crush cutting).

As used herein, when the following sheet that has at least a portion through the opening of the dispenser or package is intentionally maintained in the opening after the leading sheet is completely separated from the following sheet, this is referred to as "pop-up" format or dispensing. To be intentionally maintained in the opening means the opening is configured to so maintain the sheet therein, such as through use of a constricting opening or opening being smaller than the sheet in at least one dimension of the sheet.

As used herein, "reach-in " dispensing is understood to mean having to fetch a wipe out of a container through an opening substantially co-extensive with the walls of the container or through a restricted opening smaller than the perimeter defined by the walls. In either case, the top wipe for dispensing rests on top of the remainder of the stack of wipes and the top wipe needs to be separated from the remainder of the stack each time anew when dispensing is desired. An example of a reach-in dispenser is found in the currently available baby wipes product sold by Kimberly-Clark Corporation of Neenah, Wisconsin under the trade name HUGGIES® Supreme Care.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts depicted in the drawings are referred to by the same reference numerals.

DETAILED DESCRIPTION OF THE INVENTION

Figure 1:
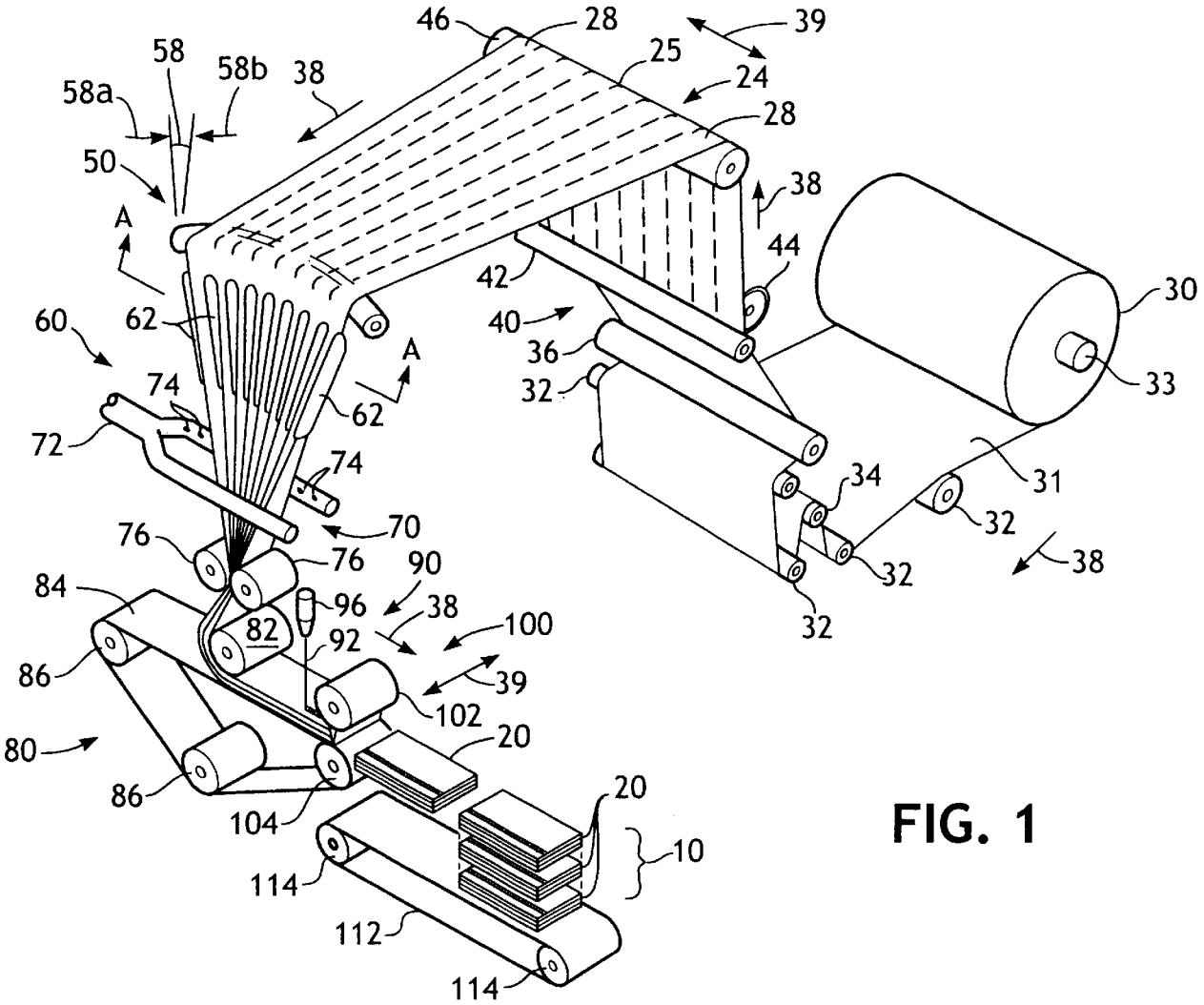
FIG. 1 representatively shows a schematic view of an apparatus and process for forming a stack of fan folded material, in accordance with the present invention.
Figure 2:
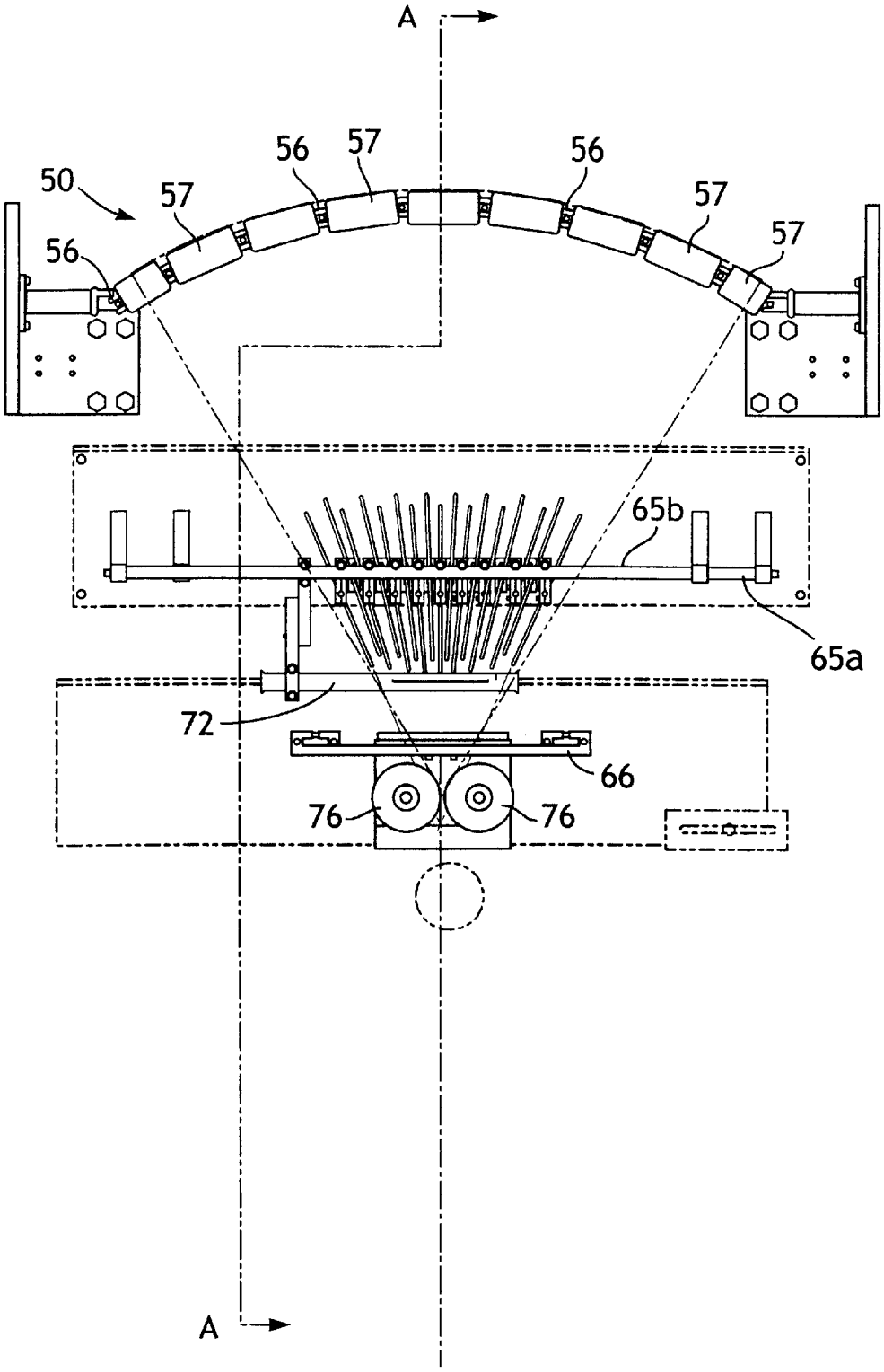
FIG. 2 representatively shows a front view of a portion of an arched roller assembly and folding assembly for use with the present invention, similar to that seen in FIG. 1.
Figure 2A:
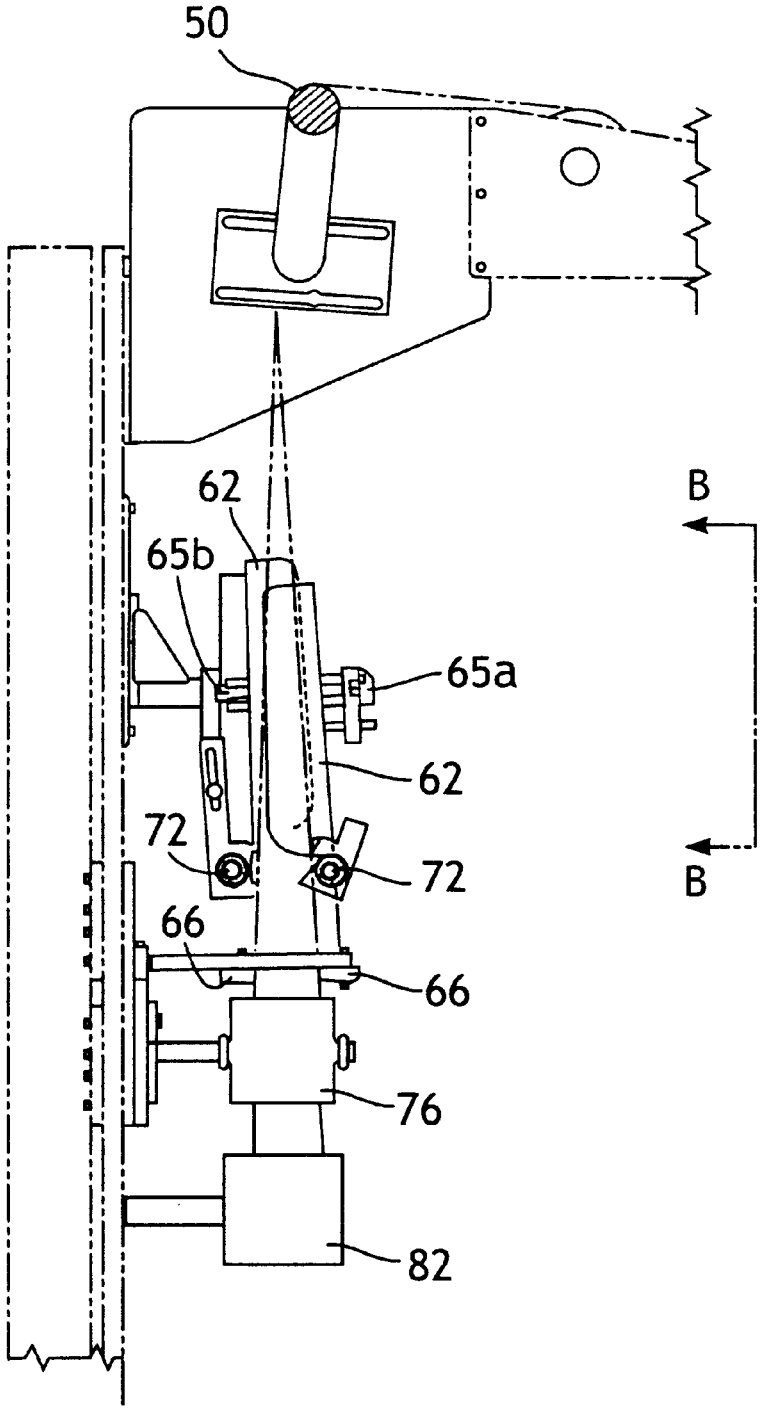
FIG. 2A representatively shows an enlarged side view of a portion of the arched roller assembly and folding assembly taken along the line A—A of FIG. 2.
Figure 2B:
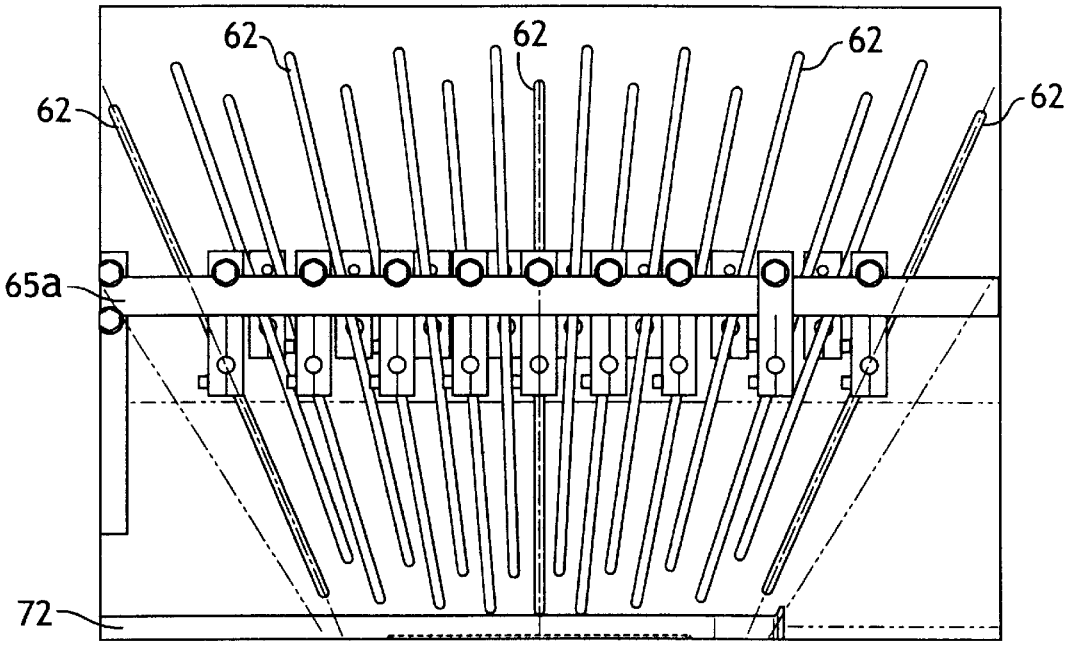
FIG. 2B representatively shows an enlarged front view of a portion of the folding assembly taken along the line B—B of FIG. 2A.

As representatively illustrated throughout the figures, and for explanation now referring to FIGS. 1 to 2B, inclusive, there is depicted an apparatus and process for making a stack 10 of fan folded material. Starting on the right side of FIG. 1, there is a roll 30 of basesheet material 31. The roll can be supported by a roll support 33. The material is fed from the roll 30 through a series of advancing rollers such as idler rollers 32 and dancer roller 34. From there the web of material 31 travels to a slitter assembly 40. The slitter assembly can include an anvil roller 42 and slitting blades 44 that form weakened lines 24 (e.g., perforated slitting blades that thereby form perforations 25) in the sheet as it travels in the machine direction 38 through the slitting assembly. As a result of traveling through the slitting assembly, the web is formed into a plurality of panels 28 joined to adjacent panels along the plurality of weakened lines 24. From there the sheet travels over an upper idler roller 46 and over to an arched roller assembly 50. The web then travels into the folding assembly 60. The folding assembly includes a series of folding boards 62 that assist in necking down the web in the cross direction 39 in a controlled fashion to induce machine direction 38 folds.

As the web travels down the folding assembly 60, it can encounter a moistening assembly 70. Assembly 70 can include a bar 72 having ports 74 for imparting liquid or solution onto the moving web as it is necked down into a fan folded ribbon of material. A liquid or solution can be provided at a desired add-on rate and in a conventional manner to the bar 72 so it can be applied through ports 74 to the moving web. Such application could include spraying or drooling with a bar like 72, or could include alternate structures (not shown) for techniques such as printing, a bath, a flooded nip, or hollowed out folding boards with spray orifices that project fluid in a rather even horizontal plane as the web moves by the boards. Alternatively, if a dry final product is desired the moistening assembly can be eliminated and otherwise the manufacturing apparatus and process could be the same. As the web travels further down the folding assembly, the sheet becomes corrugated to a point where the web is compressed in the cross direction by means of nip rollers 76. At this point, the web forms a single ribbon of fan folded sheets that then travels by a conveyor assembly 80 including a pull roller 82, support belt 84 and support rollers 86 which are an idler roller and a drive roller. The web continues travel to an adhesive application assembly 90. The adhesive assembly applies adhesive 92 via an adhesive nozzle 96 to the top of the ribbon, e.g., along an edge. Adhesive can be applied by various techniques known to those of skill in the art. For example, when the sheets comprise wet wipes, some such ways are described in a U.S. patent application filed separately but concurrently herewith entitled, "PROCESS FOR JOINING WET WIPES TOGETHER AND PRODUCT MADE THEREBY" of inventors Yung H. Huang et al., U.S. Ser. No. 09/870,815 filed May 31, 2001, assigned to the same assignee of this application, which application is incorporated herein by reference.

The ribbon with adhesive applied thereto travels on to a cutter assembly 100, which includes a rotary cutter 102 and anvil roller 104. The ribbon is then cut into discreet pieces, called clips 20, which then pass to a stacker assembly 110. The stacker assembly includes a stacker belt 112 and stacker rollers 114 which are an idler roller and a drive roller. In the stacker assembly 110, the clips 20 are stacked one upon the other and thereby the adhesive 92 the top sheet of a clip adheres to a bottom sheet of the subsequent clip that is stacked on top of it. A desired number of clips are stacked one on top of another and adhesively joined in this manner. An example of such an apparatus for use as the stacker assembly is provided with a variety of conventional wet wipe machines sold by Paper Converting Machine Company of 2300 S. Ashland Ave., Green Bay, Wis. 54307, under the tradename Triton™ Wet Wipes Machine. Other stackers that could be employed are those supplied with a ZFV™ folder, sold by Elsner Engineering of Hanover, Pa. USA or a Serv-O-Tec™ folder sold by Serv-O-Tec in Lagenfeld Germany (Serv-O-Tec is a division of Bretting Mfg. in Ashland Wis., USA). Then, the completed stack is moved to a packaging assembly (not shown) where the clips can be put in various types of dispensers (e.g., tubs, bags, etc.) and then made ready for commercial sale and use.

Figure 3A:
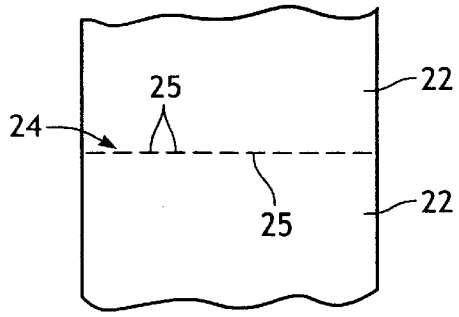
FIGS. 3A and 4A representatively show schematic top views of a portion of the sheets of FIGS. 3 and 4, respectively.
Figure 4A:
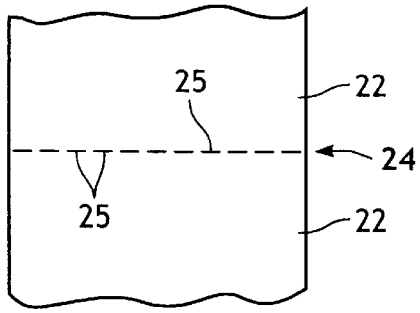
Figure 3:
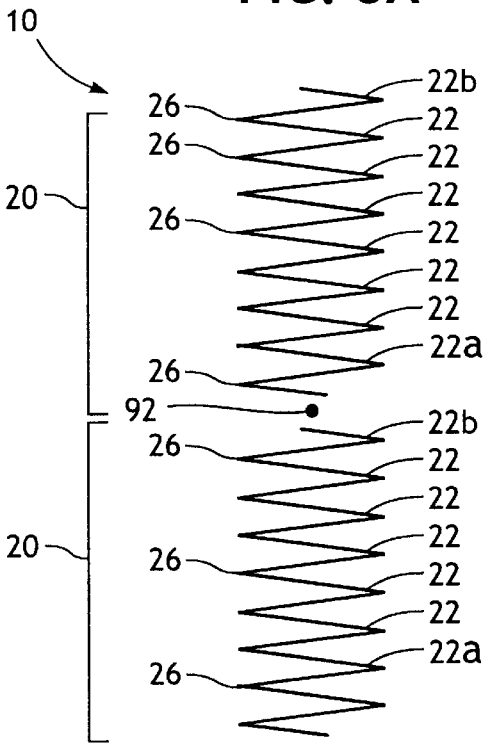
FIGS. 3, 3B, 3C and 4 representatively show schematic side views of clips of fan folded sheets, in accordance with the present invention.
Figure 4:
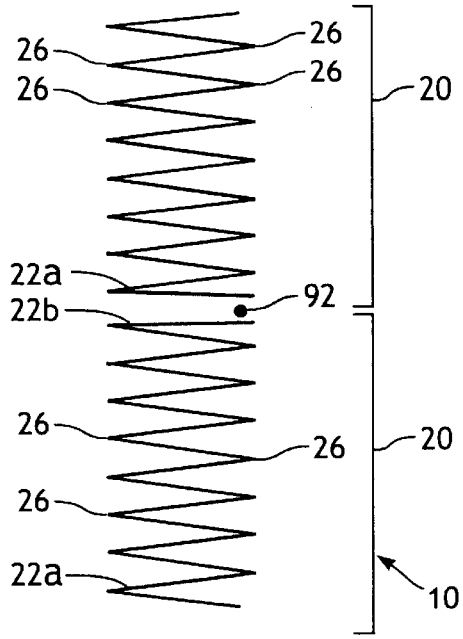

Generally, and referring to FIGS. 3 to 4A, inclusive, the invention relates to a stack 10 of at least two clips 20 where each clip comprises at least two sheets 22 separably joined together along a weakened line 24. Each clip 20 is separably joined to an adjacent clip, e.g., advantageously by the last sheet 22*a* of one clip being joined to the first sheet 22 *b* of a succeeding clip. Stacks of fan folded material within the scope of the invention can have any sheet in one clip joined to any sheet in a succeeding clip as long as dispensing of sheets from a preceding clip dispenses simultaneously at least one sheet of a succeeding clip so as to continue successive dispensing of the entire stack 10, as desired. The sheets 22 in FIG. 4 are also a plurality of individual sheets like those in FIG. 3, although each sheet is not separately numbered as in FIG. 3. The sheets 22 in FIG. 3B are also a plurality of individual sheets like those in FIG. 3. As seen in FIGS. 3A and 4A, a top view of a portion of the sheets in the clips shows the individual sheets of the clips can be separably joined together along weakened lines 24, such as lines of perforations 25, to ensure that the trailing sheet is in position for grasping by a user after the leading sheet is removed. Generally, the portion of the web of material between successive weakened lines defines each individual sheet. Folds 26, which are formed in the machine direction, generally define the width of the clip except for a situation like sheets 22*a* and the adjacent sheet in the full clip seen in FIG. 3B. In use, the invention can be dispensed in the so-called pop-up format so that once the first sheet of the stack of fan folded sheets is dispensed through a dispenser orifice, each succeeding sheet will be at least partially pulled through the dispensing orifice before the leading sheet is fully separated from the succeeding sheet, as desired. That is, each sheet within the stack is separably joined to an adjacent sheet by either a weakened line relationship or an adhesive relationship, thus enabling, as desired, one-after-another dispensing for the entire stack once the initial sheet is dispensed. Alternatively, the invention could be used for so-called reach-in dispensing, and the user would have to actively assist in separating the lead sheet from the succeeding sheet each time dispensing is desired.

Figure 5A:
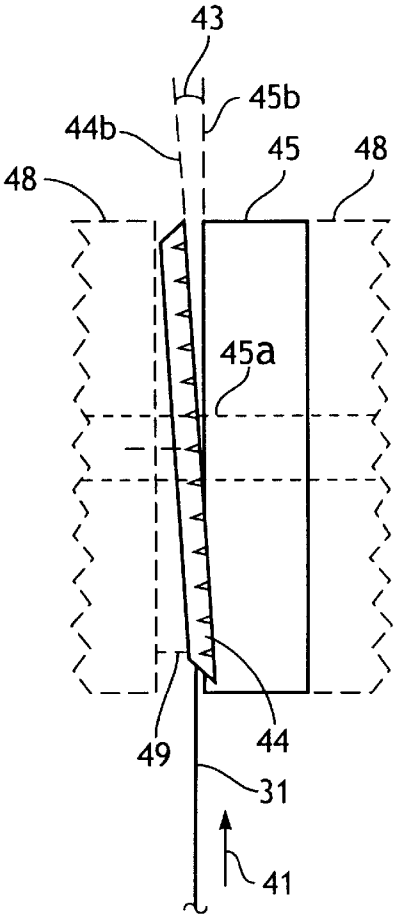
FIG. 5A representatively shows an edge view of the pair of shear slitters in FIG. 5.
Figure 5:
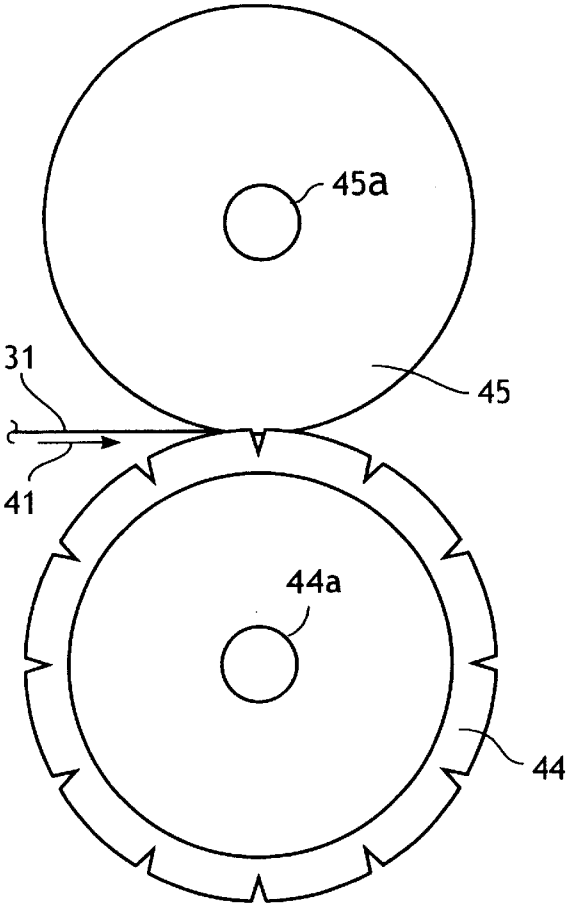
FIG. 5 representatively shows a side view of a pair of shear slitters for use with the present invention.

FIGS. 5 and 5A illustrate features for the slitter assembly 40, which can include pairs of shear slitters (i.e., one pair for each machine direction weakened line desired in the sheet of material), each pair including a perforated slitting blade 44 and a shear anvil 45. The basesheet material 31 can travel in the direction 41 through he slitter assembly. The perforated slitting blade seen in FIGS. 5 and 5A could be used in combination with the anvil roller 42 seen in FIG. 1 (i.e., one blade 44 for each machine direction weakened line desired in the sheet of material, and this combination often referred to as crush or score slitting) to thereby form a weakened line (e.g., of perforations) in the web of material traveling between the slitting blades 44 and anvil roller 42. Alternatively, anvil 45 seen in FIGS. 5 and 5A could be positioned opposite perforated slitting blades like blade 44 to thereby form a weakened line (e.g., of perforations) in the web of material traveling between the perforated slitting blades 44 and paired anvils 45. The pairs of perforated slitting blades and anvils can be adjustable relative to one another to control perforation strength, as well as have a 0.5 degree or greater cant angle to improve cutting, if desired. The cant angle is defined as 43 in FIG. 5A, which is the angle between the longitudinal axis 44*b* of the perforated slitting blade 44 and the longitudinal axis 45*b* of anvil 45. Perforated slitting blade 44 could be formed by grinding notches into a sheer slitting blade or by notching a sheer slitting blade using an EDM (electric discharge machining) process, as well as by other techniques known to those of skill in the art for making a perforated slitting blade or structure. The perforated slitting blades and anvils can be made of hardened tool steel or similar materials. In addition to varying the overlap between the slitting blade and the anvil to control perforation strength, various configurations and dimensions can be used for the notches for the perforated slitting blades, such as a v-shaped notch measuring 0.040 inch wide and being 0.080 inch deep.

The perforated shear slitting blades could all be mounted on a common shaft (not shown) through a center hole 44*a* provided they do not have a cant angle, or some or all of them could be separately supported, each by means known to those of skill in the art. Similarly, the anvils could all be mounted on a common shaft (not shown) through a center hole 45*a* or some or all of them could be separately supported, each by means known to those of skill in the art. FIG. 5A shows a portion of an anvil shaft 48 for shear slitting where there would not be the need for individual anvils 45, or how multiple anvils 45 could be mounted side by side along a common shaft. As such, an annular recess 49 would be needed opposite each perforated shear slitting blade. An example of an apparatus that could be readily employed to operate as the slitter assembly 40, in combination with the teachings herein and that of one of ordinary skill in the art, is disclosed in U.S. Pat. No. 4,570,518 of inventors Burmeister et al. of assignee Kimberly-Clark Corporation, and which is incorporated herein by reference. Other examples of slitter or cutter apparatus for use as the slitter or cutter assembly here are seen in U.S. Pat. Nos. 4,721,295 and 4,700,939 both of inventor Hathaway and of assignee Kimberly-Clark Corporation, and which are each incorporated herein by reference. Additionally or alternately, the slitter assembly could be like that sold by the Tidland Corporation of P.O. Box 1008, Camas, Wash., under the tradename Tidland™ Series C Class II Knifeholder, with slitter blades of Tidland™ part # 129839 crush cut (with notches ground in), 128401 shear cut (with notches ground in), and 133508 anvil slitter. It should be understood that other techniques and structures known to those of skill in the art for making a weakened line in a web of material could also be used to practice the invention, in combination with the teachings herein. The particular technique and structure used is not critical to the invention as long as the employed technique and structure can make the desired weakened line in the web of material as taught herein.

Figure 6B:
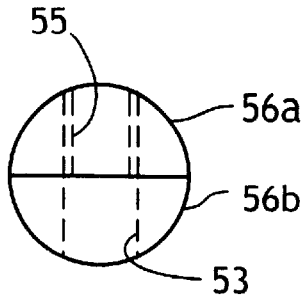
FIG. 6B representatively shows an end view of a pair of journal shafts like that seen in FIG. 6, but here as they would be joined together in the arched roller assembly.
Figure 6A:
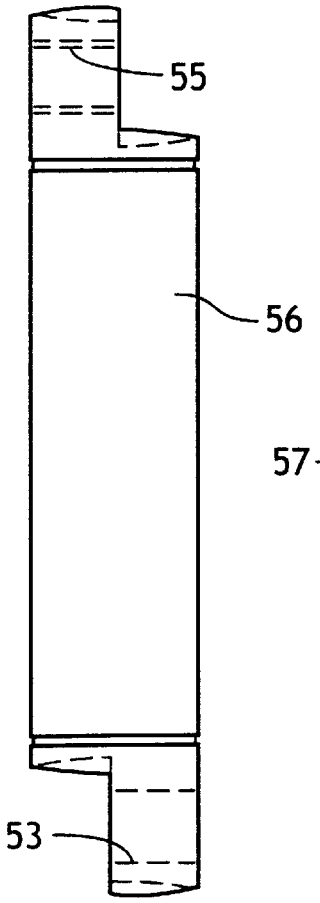
FIG. 6A representatively shows a side view of the journal shaft of FIG. 6, but with the view rotated about the longitudinal axis 90 degrees.
Figure 6:
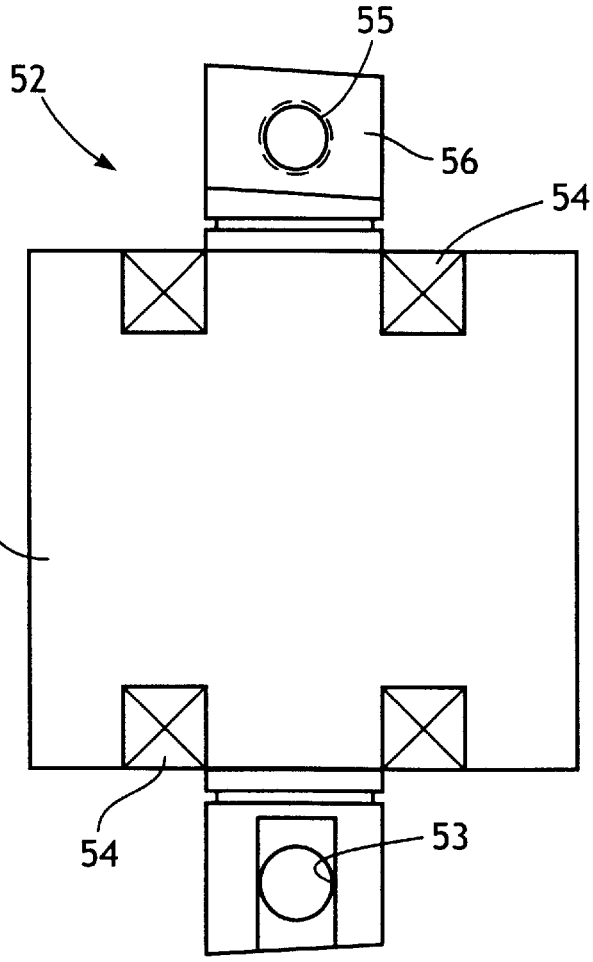
FIG. 6 representatively shows a partial cross-sectional view of a roller journal unit for use with the present invention.

Referring to FIGS. 2A and 6 to 6B, inclusive, there are illustrated features of the arched roller assembly 50. The roller assembly 50 can be arching upward at an arc to form approximately equidistant lines from the rollers 57 to the nip rollers 76 at the bottom of the fan folded sheet. For example, less arc is needed as the distance increases between the arched roller assembly and the nip rollers 76. Particularly, if the distance is sufficiently great, a conventional bowed roller assembly could be employed, and even little to no arc may be needed at sufficiently great distances. To achieve such arching as seen in the figures, a plurality of roller journal units 52 with each including a bearing unit 54, a journal shaft 56 and a roller 57, can be employed. The roller 57 fits over the unit 54 for rotation thereabout. Adjacent roller journal units 52 can be secured to one another using nuts and bolts to pass through tapped hole 53 and engage with threads 55 (FIG. 6B), or by similar means for adjustably securing two such structures. The rollers can be made of stainless steel, Actel™ plastic or other similar/substitute materials, and the other components of the roller journal units can be made of conventional materials suitable for the circumstances.

Figure 7A:
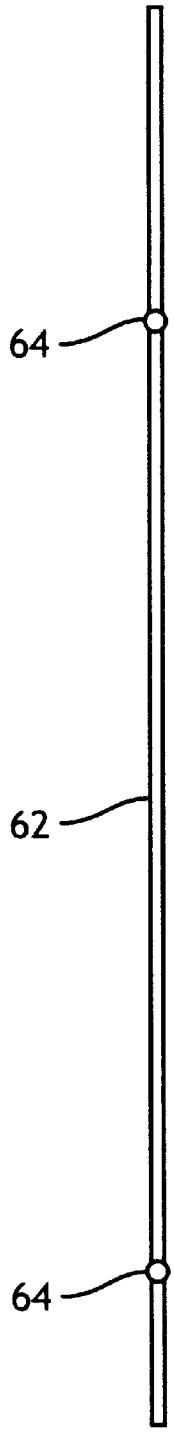
FIG. 7A representatively shows a bottom view of the folding board of FIG. 7.
Figure 7:
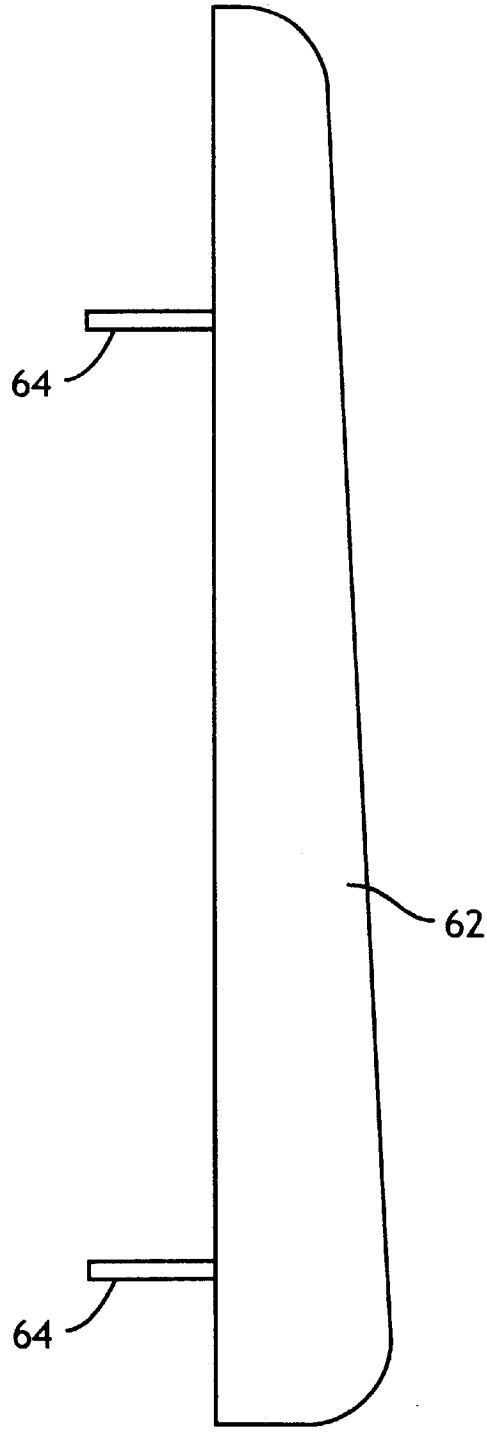
FIG. 7 representatively shows an end view of a folding board for use with the present invention.
Figure 8A:
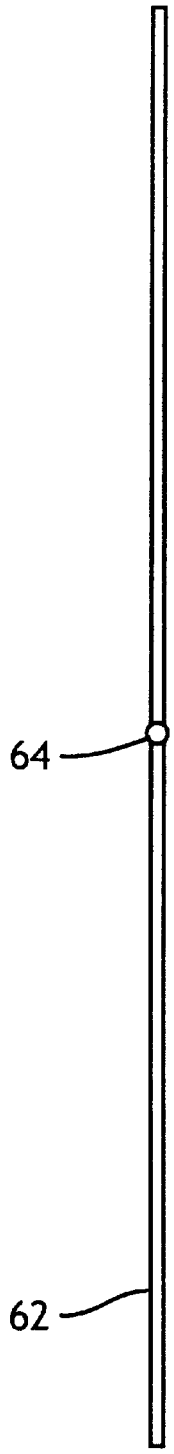
FIG. 8A representatively shows an end view of the folding board of FIG. 8.
Figure 8:
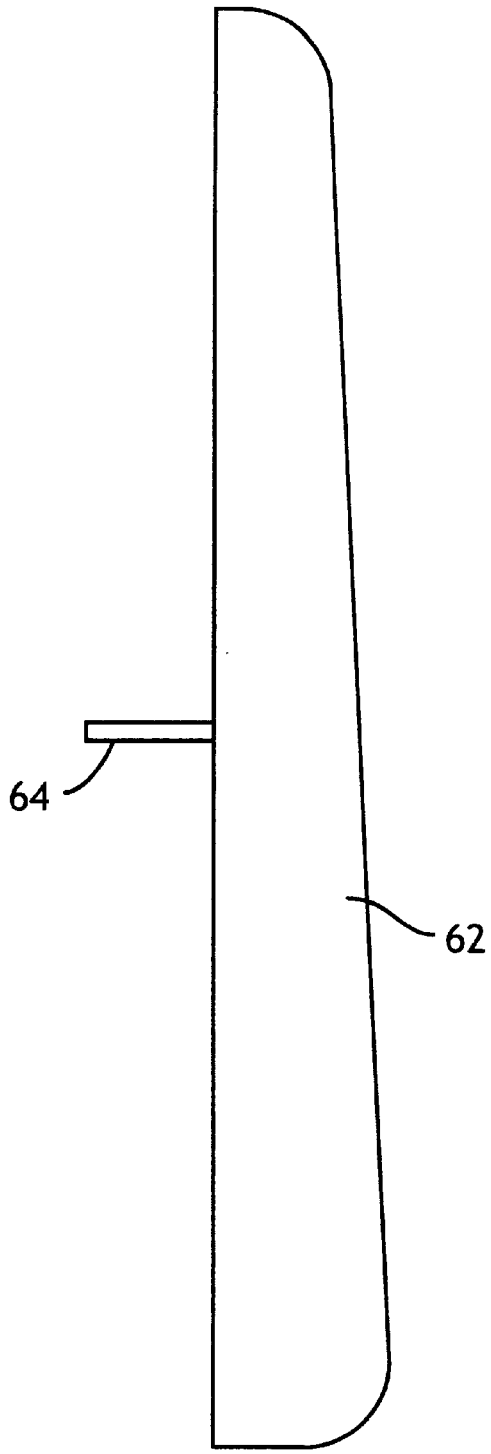
FIG. 8 representatively shows a side view of an alternate folding board for use with the present invention.

FIG. 2A in combination with FIGS. 7 to 8A, inclusive, illustrate features of the folding assembly 60, including folding boards 62. The folding board 62 of FIGS. 7 and 7A differs from that of FIGS. 8 and 8A by only the board's length, the number of mounting pins 64, and the relative location of the pin(s). Additional pins 64 could be used and the location can be varied depending on board length and the mounting mechanism available. The folding boards could be of varying lengths depending on folding and sheet material characteristics. For example, the boards could be a length equal to about ¼ of the distance from the roller assembly 50 to the nip rollers 76. The folding boards like board 62 can be non-tapered along their length or tapered from one end to a second end, as seen in the drawings. If tapered, the boards 62 can be oriented in the folding assembly 60 so the taper points upwardly, i.e., the wider end of the board sits below the narrower end of the board. The folding boards 62 can be tilted by the mounting mechanism to achieve more or less taper of the front edge relative to the top end and the bottom end, for tapered or non-tapered boards 62. The folding boards can be made of stainless steel, Actel™ plastic or other similar/substitute materials which enable corrosion resistance and sanitary considerations to be met when making sheet products such as moistened baby wipes.

FIGS. 2, 2A and 2B illustrate a portion of an arched roller assembly and folding assembly for use with the present invention, similar to that seen in FIG. 1. These figures show mounting bars 65*a* and 65*b* for mounting and positioning the folding boards as desired. Bars 66 can also be used to assist in aligning the fan folded material as it exits the folding board area and travels into the nip rollers 76. The number of boards 62 can be readily varied in order to achieve a desired folding pattern, as one of ordinary skill in the art would know to do in combination with the teachings herein, e.g., FIGS. 3, 3B, 3C and 4. Also, other folding techniques and structures could be employed to practice the invention, e.g., folding blades, folding pins or other techniques to mechanically push or guide the sheet into a desired folding pattern. In reference to FIG. 2A for example, boards 62 can be adjustably secured to a conventional mounting mechanism similar to that seen here. As such, boards 62 mounted by bar 65*a* are positioned in the front of the material being fan folded (i.e., and such could be visible in a view like FIG. 1) and boards 62 mounted by bar 65*b* are positioned in the back of the material being fan folded (i.e., and such could not be visible in a view like FIG. 1). In this way the sheet of web material zigzags between the adjacent folding boards as it is folded from a flat sheet near the arched roller assembly 50 into a fan folded configuration beginning at the top of the folding boards nearest the roller assembly 50 down to the bottom of the folding board area and nearest the nip rollers 76.

Figure 1A:
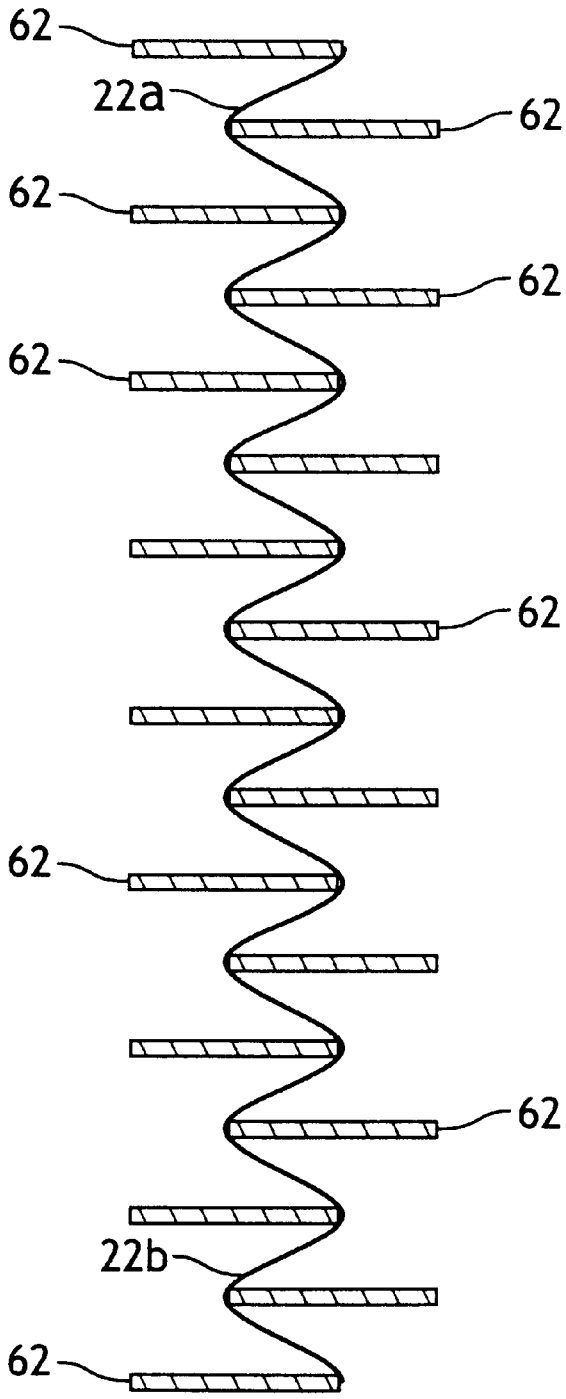
FIG. 1A representatively shows a cross sectional view of a portion of the apparatus of FIG. 1, taken along the line A—A.

As seen in FIG. 2, and with reference to FIGS. 1 and 1A, the folding boards are spaced from each other a certain amount in both longitudinal and lateral directions. As the web being fan folded travels further down the folding boards and towards the nip rollers 76 the folding boards will be spaced closer together in both the longitudinal and lateral directions, and thereby the flat sheet material is fan folded into a ribbon-like structure including a plurality of fan folded sheets. The folding boards can be oriented in a fanned out configuration as seen in the Figures. FIG. 2 shows a possible configuration for such boards. Theoretical fold lines extend parallel to each of the folding boards. Theoretical weakened lines extend parallel to every other folding board. Theoretical panels extend between each set of weakened lines. In practice, except for the center location, the actual weakened lines, panels and fold lines of the material being fan folded will often be askew relative to all of the respective theoretical locations discussed. Although the folding boards form the fold lines, the sheet of material will slide over the boards and gather towards the center of the sheet (i.e., the middle folding board seen in FIG. 2) and the actual fold lines will often not be set until the material is past the folding board area and is ready to enter the nip rollers 76.

The ultimate orientation of all the folding boards as a group, as well as folding boards relative to one another, can depend on many factors. Such factors can include, without limitation, the characteristics of material being folded, the liquid add-on amount to the material, the strength of the weakened line between adjacent panels, operating speeds, necking of the material, desired folding pattern for the sheets, or distance between roller assembly 50 and the nip rollers 76. Adjusting these factors to enable a sheet of material to be fan folded in accordance with the invention can be done as would be known to one of ordinary skill in the art to do, in combination with the teachings herein. For example, the tension of the sheet can be adjusted (e.g., a draw in the range of about 1% to about 10%, or about 3% to about 6% or about 4%) to enhance the folding process depending on one or more of the just-discussed factors. As another example and referring to FIG. 1, to relieve CD tension on the sheet and/or assist it in passing through the folding assembly 60, the arched roller assembly 50 can be tilted backward to some degree (e.g., from about 1 degree to about 10 degrees or from about 3 degrees to about 7 degrees or about 5 degrees) from vertical seen at 58*a* to backward off vertical seen at 58*b*, and represented by angle 58. As yet another example, when employing such a tilted arched roller assembly, the folding boards can be spaced more towards the center of the web traveling through assembly 60 than would be suggested by theoretical fold lines. As still another example, the weakened lines, e.g., of perforations, can be positioned along the folding boards or theoretical fold lines or in between these. As yet another example, the sheet material could be any width to obtain a desired number of sheets in a clip. To obtain eight sheets as representatively seen in certain Figures, e.g., a sixty inch wide roll of basesheet material could be used and sheets measuring seven and one-half inches between perforated edge ends can be formed.

Figure 9:
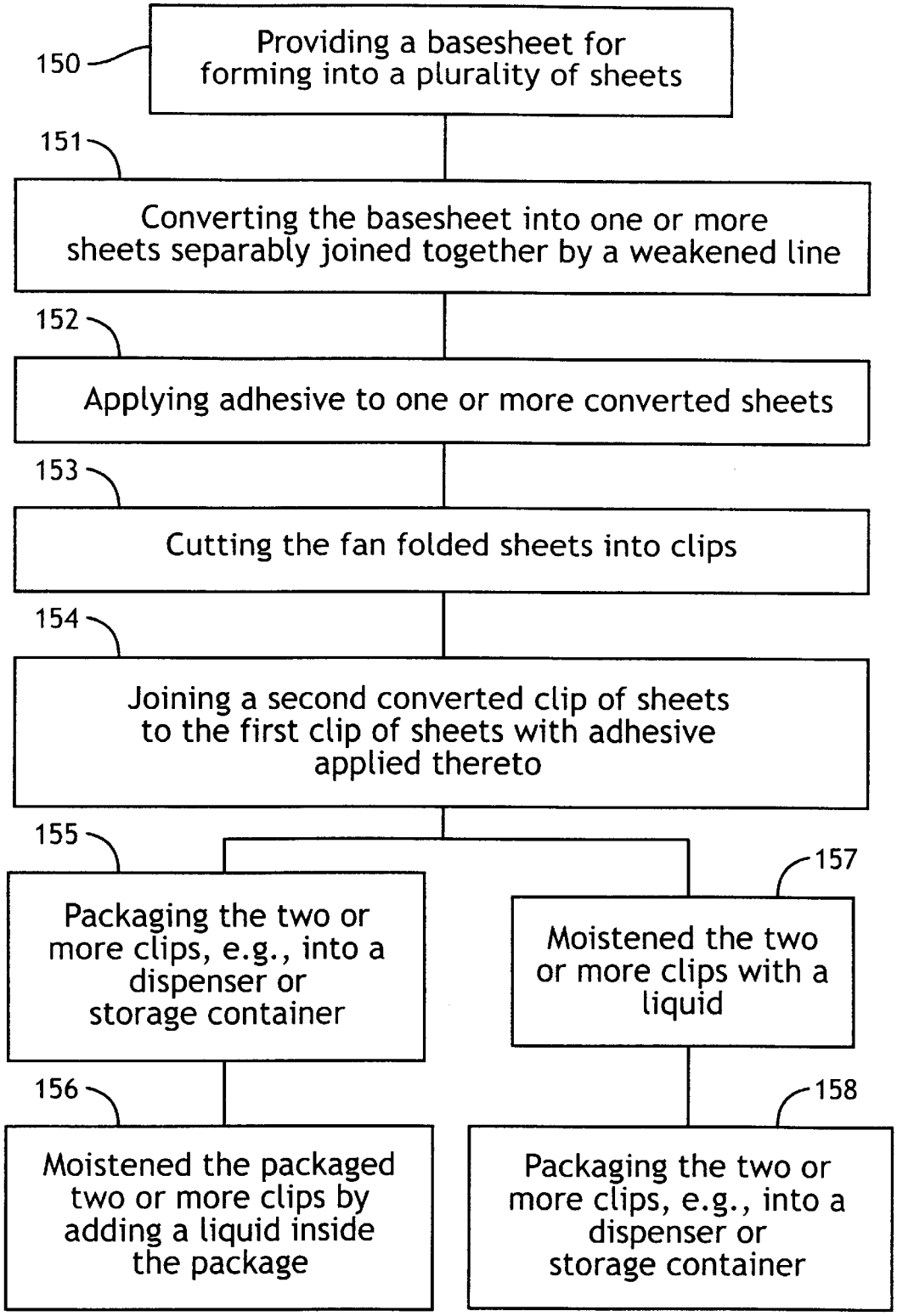
FIG. 9 representatively shows a schematic diagram for making sheets, e.g., wet wipes, in accordance with the present invention.
Figure 10:
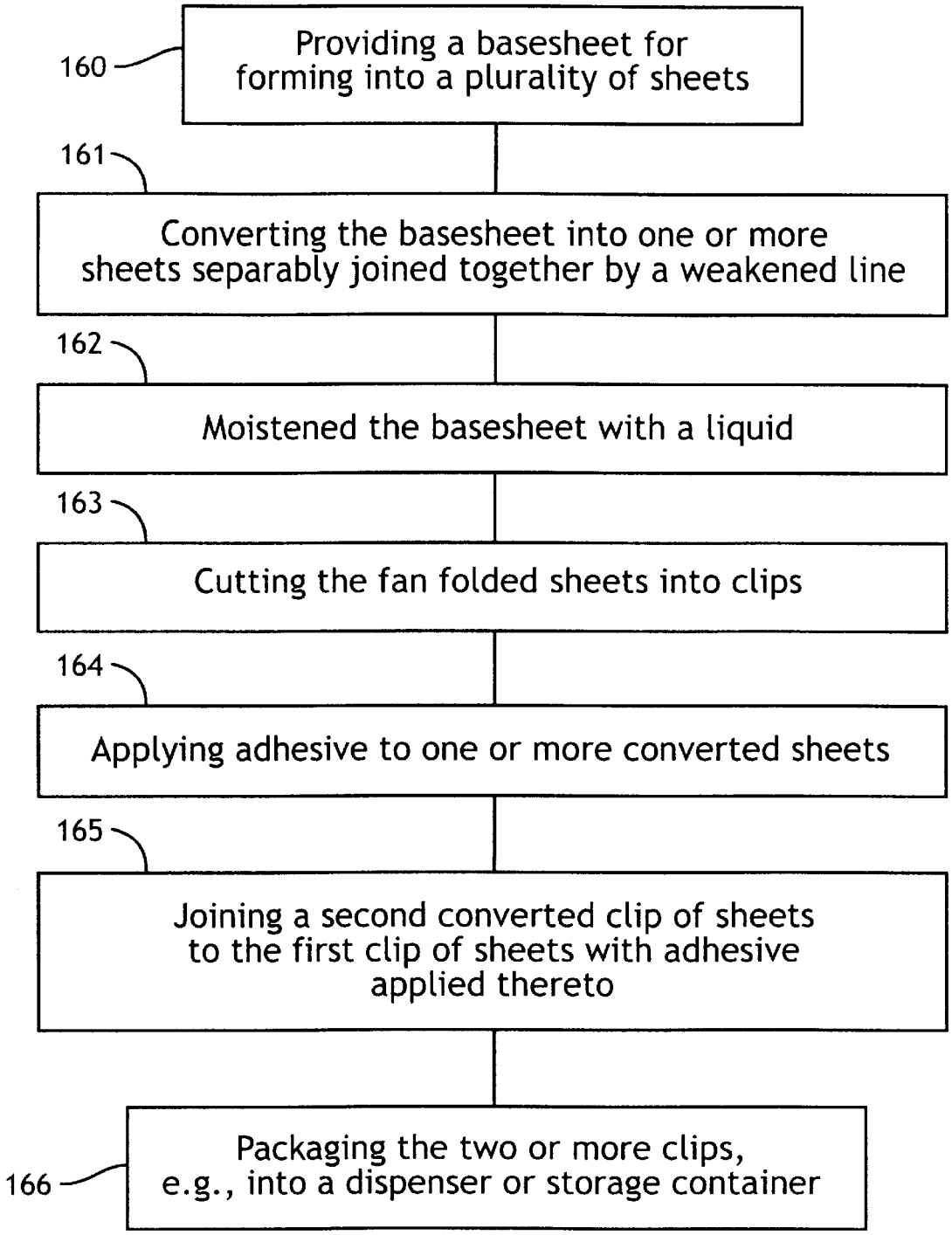
FIG. 10 representatively shows a schematic diagram for alternately making sheets, in accordance with the present invention.

FIGS. 9 and 10 schematically show representative steps for making a plurality of sheets 22 of the present invention for a wet or moistened product. Alternately, similar steps could be employed excluding any moistening step if a final dry product is desired, e.g., for tissues, toweling or other sheet-like products. Each of these steps can be specifically performed according to the teachings herein or as would be known to one skilled in the art, depending on particular circumstances, in combination with the teachings herein. These steps are described as follows, generally in the following order though not required. First steps 150 and 160 can be the same, namely, providing a basesheet for forming into a plurality of sheets. After step 150 is step 151 of converting the basesheet into one or more sheets separably joined together by a weakened line. This usually includes forming several panels from a larger basesheet of material. After the forming of individual panels, converting also includes fan folding the sheets such as to form a ribbon of fan folded sheets. Next, adhesive can be applied to the top fan folded sheet in step 152. Then the elongated fan folded sheets, or ribbon, are cut into clips, in step 153. Next, a second clip is placed on top of the first sheet of the below clip of sheets and joined to the first sheet with adhesive applied thereto, in step 154. As used herein "applying" means any way to get adhesive onto the two sheets that are adhesively joined together, which can include without limitation, spraying, rolling, squirting, drooling, painting, coating and/or printing. This also includes getting the adhesive onto the two sheets in any order (as between the two sheets being joined by adhesive) or simultaneously. Next, the stack of sheets is ready for the final steps of 155/156 or 157/158, which include packaging and moistening, in either order as shown. The sheets are now ready for consumption by a user.

FIG. 10 shows an alternate set of steps for making sheets of the invention. The principal difference is that here, the basesheet is moistened in step 162 in advance of applying adhesive in step 164. Although converting in step 161 is shown to precede moistening step 162, steps 161 and 162 can be reversed and they can occur near simultaneously, all dependent upon how many sub-steps are employed in the converting step 161. Such sub-steps are known to those of skill in the art and are often driven by economics or equipment to obtain a desired fold for the plurality of sheets. Otherwise, steps 163 to 166 are analogous to above described steps 153, 152, 154 and 155/158 respectively. To the degree not specifically discussed, the various features set forth herein or illustrated in the drawings can be made with structures and by techniques known to those of ordinary skill in the art.

Referring generally to the figures now, the plurality of sheets 22, such as a stack 10 of sheets, can include any suitable number of individual sheets depending upon the desired packaging and end use. For example, the stack 10 can be configured to include at least about 5 wet wipes and desirably from about 16 to about 320 individual sheets, and more desirably from about 32 to about 160 sheets. The size and shape of the stack of sheets 22 is dependent upon the size and shape of the package/dispenser and vice versa. For example, the length of an assembled stack of wet wipes sheets can be about 190 mm, with a height of about 90 mm and a width of about 100 mm.

Each sheet is generally rectangular in shape and defines a pair of opposite side edges and a pair of opposite end edges which can be referred to as a leading end edge and a trailing end edge. Each sheet defines an unfolded width and an unfolded length. The sheets can have any suitable unfolded width and length. For example, sheets of wet wipes can have an unfolded length of from about 2.0 to about 80.0 centimeters or from about 10.0 to about 26.0 centimeters and an unfolded width of from about 2.0 to about 80.0 centimeters or from about 10.0 to about 45.0 centimeters.

Materials suitable for the sheets of the present invention are well known to those skilled in the art. The sheets can be made from any material suitable for use as a wipe, including meltblown, coform, airlaid, bonded-carded web materials, spunlace, hydroen tangled materials, high wet-strength tissue and the like and can comprise synthetic or natural fibers or combinations thereof. For wet wipes, they can have a dry basis weight of from about 25 to about 120 grams per square meter or from about 40 to about 90 grams per square meter.

In a particular aspect, sheets of wet wipes of the present invention can comprise a coform basesheet of polymeric microfibers and cellulosic fibers having a basis weight of from about 60 to about 100 grams per square meter or about 80–85 grams per square meter. Such coform basesheets can be manufactured generally as described in U.S. Pat. No. 4,100,324 to Anderson et al. which issued Jul. 11, 1978, and which is herein incorporated by reference. More particularly, such coform basesheets can be manufactured as are described as part of recently filed U.S. patent application Ser. No. 09/751,329, filed on Dec. 29, 2000 entitled, "Composite Material With Cloth-like Feel" of inventors Scott R. Lange et al., and which is incorporated herein by reference. Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet can comprise from about 20 to about 100 weight percent, from about 20 to about 60 weight percent, or from about 30 to about 40 weight percent of polymeric microfibers based on the dry weight of the coform basesheet being used to provide the wet wipes. An example of such a coform basesheet for use in the present invention is found in the baby wipes product presently sold by Kimberly-Clark Corporation and known as HUGGIES® Natural Care.

In another aspect of the invention, wipes 22 can contain a liquid which can be any solution which can be absorbed into the wipes, thus making them "wet wipes." The wipes can be moistened at any time before the wipes are actually used by the consumer. They can be moistened some time during the manufacturing process before or contemporaneous with the plurality of wipes being sealed in a dispenser or other packaging for next use by a product user. The liquid contained within the wet wipes can include any suitable components which provide the desired wiping properties. For example, the components can include water, emollients, surfactants, preservatives, chelating agents, pH buffers, fragrances or combinations thereof. The liquid can also contain lotions, ointments and/or medicaments. An example of such a liquid for use in the present invention is found in the baby wipes product presently sold by Kimberly-Clark Corporation and known as HUGGIES® Natural Care.

The amount of liquid or solution contained within each wet wipe can vary depending upon the type of material being used to provide the wet wipe, the type of liquid being used, the type of container being used to store the stack of wet wipes, and the desired end use of the wet wipe. Generally, each wet wipe can contain from about 25 to about 600 weight percent or from about 200 to about 400 weight percent liquid based on the dry weight of the wipe, for improved wiping in certain situations. To determine the liquid add-on, first the weight of a just-manufactured dry wipe is determined. Then, the amount of liquid by weight equal to the weight of the just-manufactured dry wipe, or an increased amount of liquid measured as a percent add-on based on the weight of the just-manufactured dry wipe, is added to the wipe to make it moistened, and then known as a "wet wipe" or "wet wipes". In a particular aspect wherein the wet wipe is made from a coform material comprising from about 30 to about 40 weight percent polymeric microfibers based on the dry weight of the wipe, the amount of liquid contained within the wet wipe can be from about 250 to about 350 weight percent or about 330 weight percent based on the dry weight of the wet wipe. If the amount of liquid is less than the above-identified range, the wet wipes can be too dry and may not adequately perform depending on the intended use. If the amount of liquid is greater than the above-identified range, the wet wipes can be over saturated and soggy and the liquid can pool in the bottom of the container, as well as contribute to problems with the adhesive 92 sticking to the surface of wet wipe sheets 22.

Figure 11:
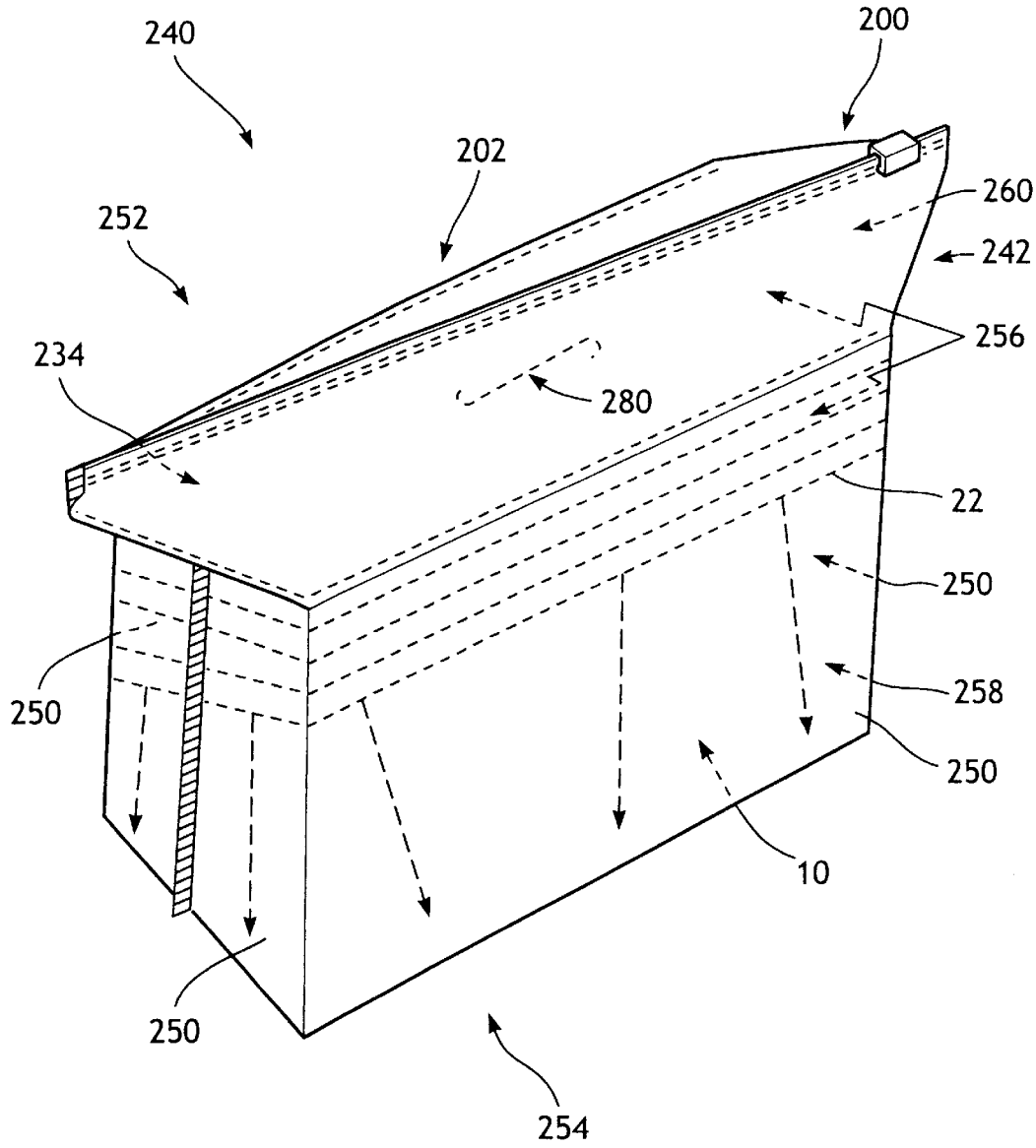
FIG. 11 representatively shows a perspective view of a type of non-rigid dispenser for use with wipes of the present invention, where wipes are sealed therein and the dispenser is sealed closed.
Figure 12:
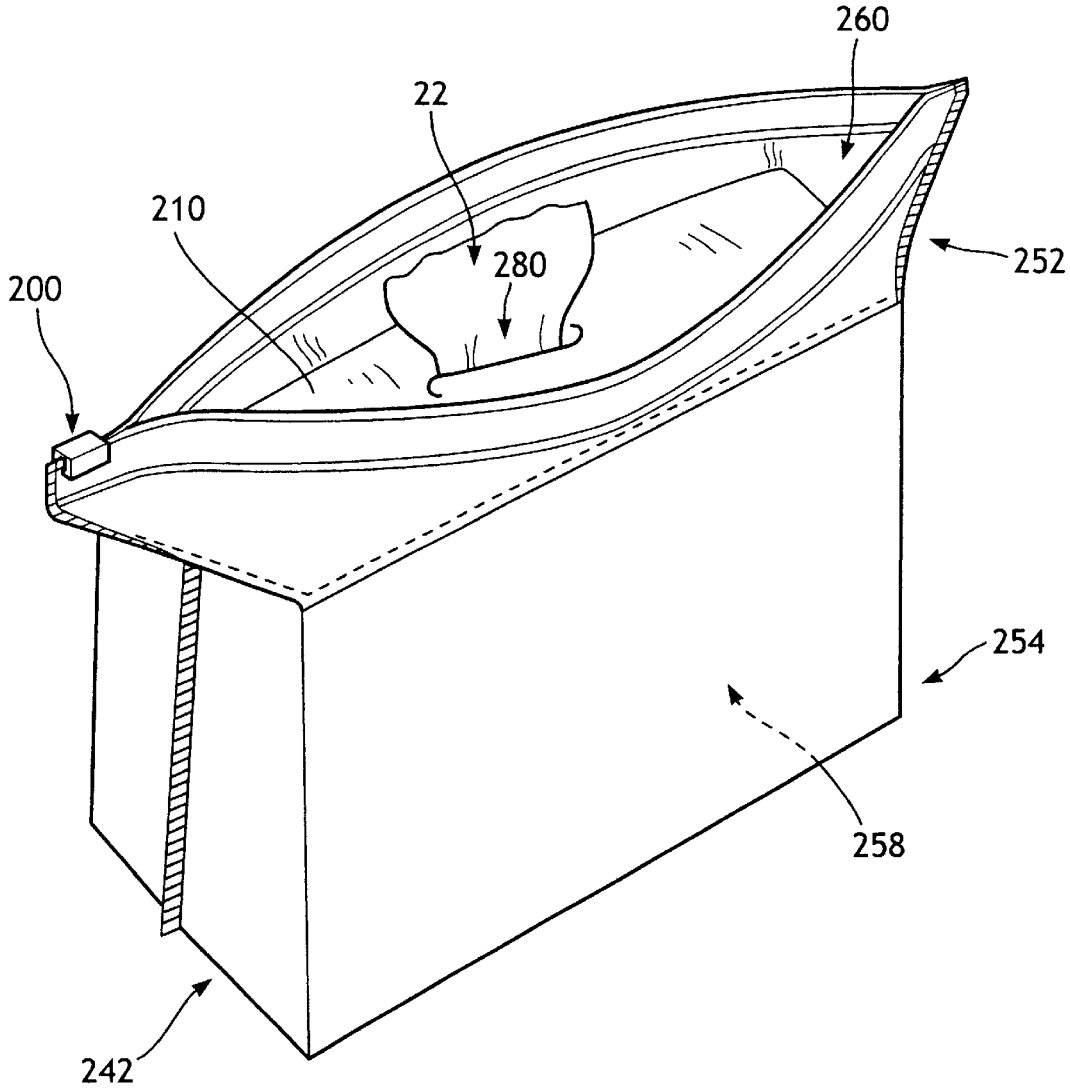
FIG. 12 representatively shows a perspective view of the dispenser of FIG. 11, where a wipe is ready for pop-up dispensing and the dispenser is open.

The plurality of sheets 22 of the present invention, e.g., wet wipes, can be arranged in a package or dispenser in any manner which provides convenient and reliable one at a time dispensing, and for wet wipes which assists the wet wipes in not becoming overly dry. An example of non-rigid containers for use with the present invention are disclosed in U.S. Ser. No. 09/813,536, filed Mar. 21, 2001 and entitled "STORAGE AND DISPENSING PACKAGE FOR WIPES" and assigned to the assignee of the present application, which prior application is incorporated fully herein by reference. FIGS. 11 and 12 show one such storing and dispensing package 240 for wipes or sheets 22. The package 240 includes a non-rigid container 242 having sides 250 with a top end portion 252 and a bottom end portion 254, where the sides and top and bottom end portions define a cavity 256 within the container 242.

The cavity 256 includes a storage portion 258 for wipes 22. The top end portion 252 can include a resealable mechanism 200. A non-rigid baffle structure 210 has a width and is located in between the resealable mechanism 100 and the storage portion 58 with the baffle structure 210 positioned between opposing sides 250 of the container spaced apart from each other. The baffle structure thereby defines a dispensing portion 260 of the cavity 256 overlying the storage portion 258 of the cavity. As seen in FIG. 11, the resealable mechanism 200 is in a sealed closed position 202, whereas in FIG. 12 it is in an open position with a wipe 22 inside the container ready for pop-up dispensing. The mechanism 200 can be any type of mechanism that allows the package 240 to be opened, and reopened multiple times during the life of the package, e.g., a zipper with or without a stopper, resealable adhesive, a clip or other structure that achieves the result desired here.

In use, the resealable mechanism 200 is opened and then access to the dispensing portion 260 is gained. The user then passes his or her hand, etc., through the orifice 280 to grab the first wipe in the stack of wipes. If the orifice is a frangible seal, this must be broken before the user can pass his or her hand through the orifice. Once the user grabs the wipe, it can then pass through the orifice and enter the dispensing portion 260 as the user pulls it up. If the user does not immediately need the wipe, it can be left in the orifice partially dispensed where it can be maintained in place by the baffle structure 210 until desired later. The partially dispensed wipe will just rest in place in the orifice, part in the dispensing portion and part in the storage portion, conveniently ready for later dispensing in the pop-up format. If the user does immediately desire to use the wipe, it can pass the complete wipe through the dispensing portion and out of the package. For pop-up dispensing, the wipe will become separated or disjointed from the subsequent adjacent second wipe at a separably joined interface (e.g., weakened line, adhesive joint, or other mechanism) after fully dispensing the first wipe and while a portion of the second wipe remains in the opening or orifice 280. The next wipe for dispensing may be automatically maintained in the orifice partially dispensed for later use (i.e., in a pop-up dispensing format). Alternatively, the following wipe may need to be fetched out of the storage portion similar to the first wipe at a later time when it is desired, commonly called reach-in dispensing, if the user pushed the following wipe back into the storage portion after pop-up dispensing of the leading wipe. In either case, after the desired number of wipes are taken, the resealable mechanism can be sealed closed, with or without a wipe partially dispensed in the dispensing portion, as discussed previously. At a later time when another wipe(s) is desired, the preceding steps can generally be followed again. In this regard, the user can pull a subsequent third wipe through the dispenser opening and then separating the third wipe from a subsequent adjacent fourth wipe at a separably joined interface between the third and fourth wipes. Depending on the number of sheets in a clip and where in the stack dispensing is occurring, the separably joined interface can be a different type of separably joined interface than that of the previously separated first and second wipes. It should be understood that reference here to first, second, third and fourth wipes or sheets does not mean only sequential sheets one, two, three, and four (i.e., though it can refer to these also), but rather, such is used for reference purposes to refer to different sheets within a clip or stack of sheets and in relation to when in time such sheets are dispensed relative to one another.

Figure 13:
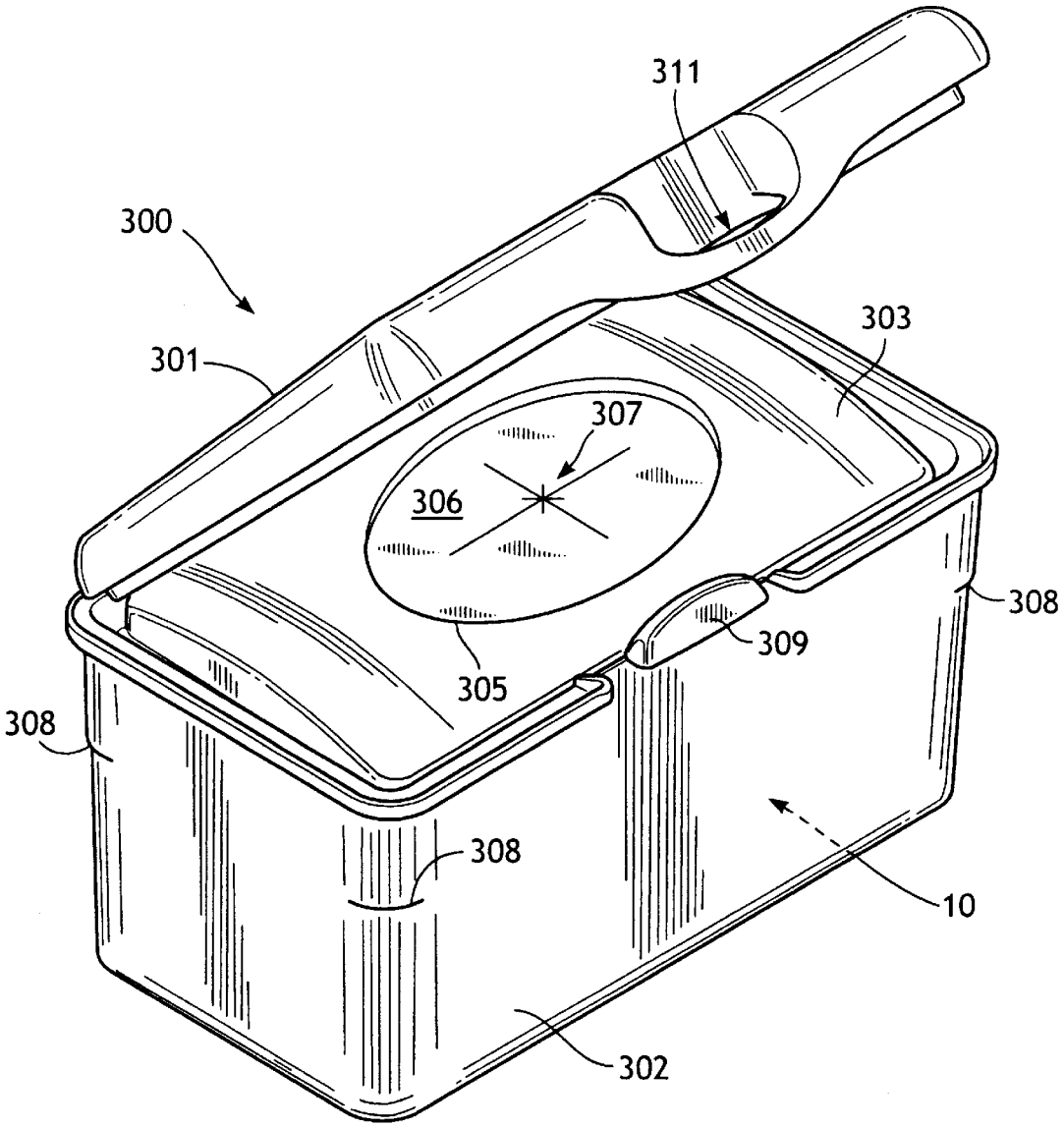
FIG. 13 representatively shows a perspective view of a type of rigid dispenser for use with wipes of the present invention, where wipes are sealed therein and the dispenser top is open.

An example of rigid containers suitable for use with the present invention are disclosed in U.S. Ser. No. 09/538,711 filed Mar. 30, 2000 entitled "WET WIPE CONTAINER WITH FLEXIBLE ORIFICE" and assigned to the assignee of the present application, which prior application is incorporated fully herein by reference. FIG. 13 shows such a rigid plastic wet wipe dispenser 300. Dispenser 300 includes a top 301 hingedly attached to a base 302 and a removable inner cover 303. The removable inner cover contains a pop-up style wipe dispenser including a rigid port 305 which surrounds a flexible, rubber-like material or sheet 306 having a dispensing opening 307. The dispensing opening 307 is illustrated as several slits through which individual wet wipes are removed from the container. The cover is removably secured to the sidewalls of the base by a small lip around the periphery of the inner cover that engages notches with several protruding ribs on the inner surface of the sidewalls (not shown). It also rests on a small support surface in each of the four corners of the base, which is outwardly visible by discontinuities 308 in the rounded corners of the base. The top is secured in a closed position by a suitable latching mechanism, in which a protrusion 309 in the front lip of the base is engaged by an opening 311 in the front lip of the top. The shape of the rigid port in the embodiment shown in FIG. 13 is oval, but can be any shape and size large enough to enable the user to reach into the container with their fingers to grasp the next available wet wipe in the event of a dispensing failure, or if reach-in dispensing is preferred to further aid in moisture retention of the wipes. Generally, use of dispenser 300 for dispensing wipes 22 is similar to that for package 240, except when due to obvious structural differences.

TABLE

| Separably Joined Inter-face | Width of Sheet (cm) | Dispensing Force (g/sheet) Type 1 Dispenser | Dispensing Force per unit Width (g/cm) Type 1 Dispenser | Dispensing Force (g/sheet) Type 2 Dispenser | Dispensing Force per unit Width (g/cm) Type 2 Dispenser | Dispensing Force (g/sheet) Type 3 Dispenser | Dispensing Force per unit Width (g/cm) Type 3 Dispenser |
|---|---|---|---|---|---|---|---|
| Adhesive | 18.75 | 555.5 | 29.6 | 474.7 | 25.3 | 437.1 | 23.3 |
| Perforations | 18.75 | 368.2 | 19.6 | 371.2 | 19.8 | 337.0 | 20.1 |

The Table sets out data obtained from samples made in accordance with the teachings of the invention. Samples were made from a basesheet of coform comprising the same material known as the baby wipes product currently available from Kimberly-Clark Corporation of Neenah, Wis. under the tradename HUGGIES® Natural Care and moistened with 330% add-on of that solution set forth in pending U.S. Pat. application Ser. No. 09/464,418, filed on Dec. 16, 1999 entitled, "Wet Wipes Containing A Monoalkyl Phosphate" of inventors Cole et al., and which is incorporated herein by reference. The samples labeled as "Adhesive" were two adjacent sheets, e.g., 22*a* and 22*b*, from two clips of sheets separably joined together by adhesive, whereas the samples labeled as "Perforations" were two adjacent sheets within a clip of sheets separably joined to each other by a line of perforations. The Adhesive samples used the same hot melt adhesive, commonly known as RT 2730 APAO sold by Huntsman Polymers Corporation of 2502 South Grandview, Odessa, Tex. 79766. The adhesive was applied to the moistened coform with a one port spray head part # 103968 and MR1300 transfer block manufactured by ITW Dynatec (see below). The spray head was fitted with a swirl nozzle, part # 057B1922 with a 0.020 inch orifice, spraying a continuous pattern approximately 18 mm away from the moistened basesheet. The adhesive was provided from a Dynamelt™ melt tank and pump system, model #084E428, manufactured by ITW Dynatec of 31 Volunteer Drive, Hendersonville, Tenn. An ITW Dynatec 16-foot long transport hose, part # 101088D, fit to the spray head and supplied the melted adhesive from the melt bank to the spray head. The adhesive was applied in a substantially uniform swirl pattern about 1.25 cm wide along a leading edge (i.e., the width) of the top wipe in the clip, similar to that seen in FIG. 1.

Figure 3C:
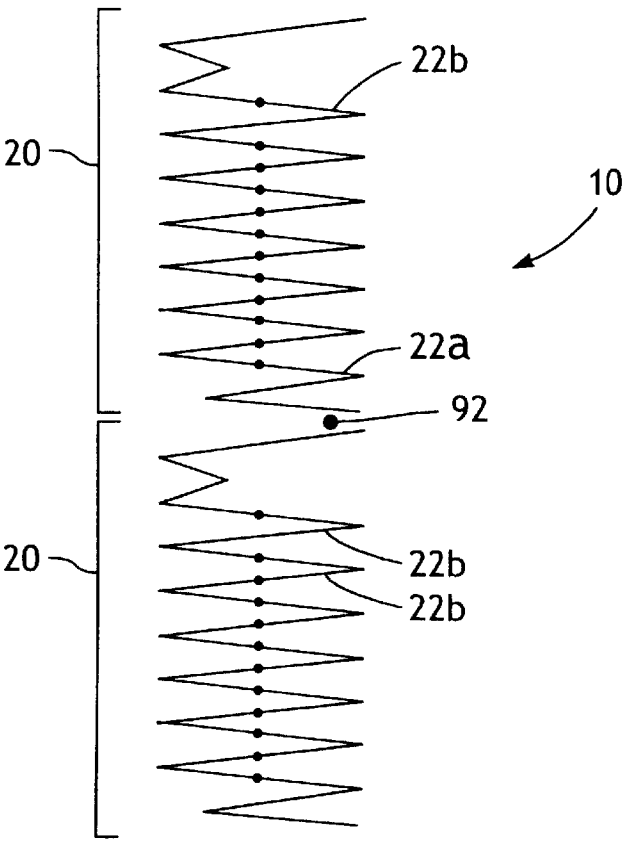
Figure 3B:
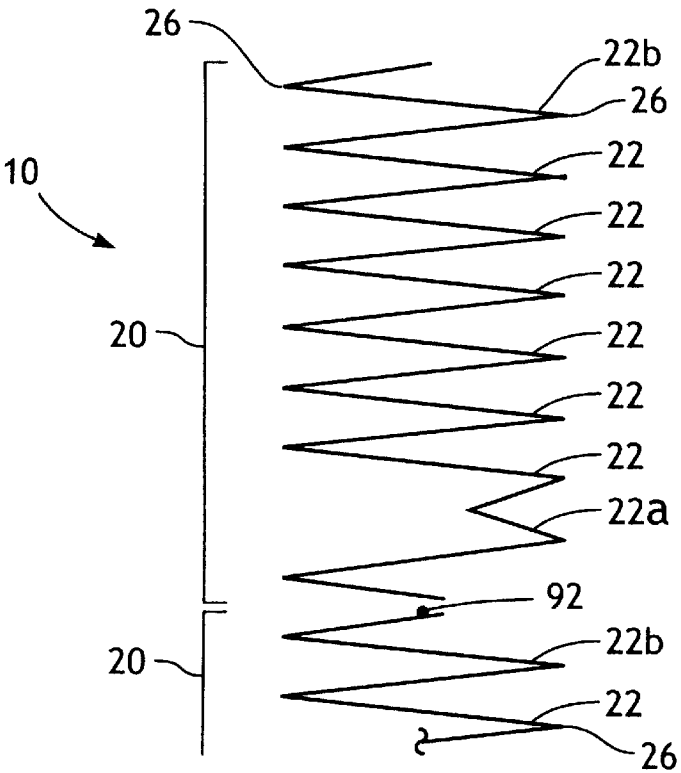

To prepare the samples, the basesheet material was formed into fan folded clips of eight sheets, similar to that in FIG. 3C, each sheet in the clip separably joined to an adjacent sheet(s) by perforations. Perforation refers to the amount of cutting and the distance between the cuts in the perforation that separates the sheets in a clip. There are three parameters to this measurement: cut length, bond length and bond spacing. The bond spacing is equal to the sum of the cut length plus the bond length. By way of example, perforations that are useful with sheets, e.g., wet wipes of the invention, are ones that have a bond length in the range of 0.070 inch (1.75 mm) to 0.020 inch (0.5 mm), a cut length in the range of 0.055 inch (1.375 mm) to 0.73 inch (18.25 mm), and a bond spacing in the range of 0.125 inch (3.125 mm) to 0.75 inch (18.75 mm). Ultimately, however, desired perforation configurations are dependent upon many factors including basesheet characteristics (e.g., fiber composition, formation process, bulk, density, thickness, weight, CD tensile, MD tensile), desired dispensing characteristics (e.g., type of dispensing, type of dispenser, wet or dry dispensing) and others that can affect how one sheet separates from another sheet and/or dispenses from a dispenser. The sheets seen as the samples labeled "Perforations" in the Table had a detach force as determined herein of about 453 grams per sheet. Ten clips were adhesively joined together to form a stack of wet wipes sheets.

The adhesive was applied to the top surface of the first wet wipe of a clip moving at a speed of about 320 ft/minute. The adhesive was maintained at about 375 degrees Fahrenheit and system pressures were adjusted to obtain the desired add-on through the nozzle of about 0.00060 grams/wipe. Then, the second wipe was laid on top of the first wipe with adhesive thereon within about 3–4 seconds. About 2 seconds later, a pressure about ⅓ psi was uniformly applied on top of the second wipe for fractions of a second to a few seconds. This pressure could vary from 0 (i.e., the weight of the clip of wipes itself) to 2 psi (i.e., by the use of an additional force), as well as possible other pressures. The stack of wipes with adhesive applied thereon were placed in a sealed container, such as a plastic bag and allowed to rest for 2 to 6 days. The sealed container of wipes was then placed in a test lab and allowed to equilibrate to room temperature of about 20 degrees Celsius for 24 hours, remaining sealed in the container until testing. The samples were then measured for the force needed to separate or detach two separably joined wipes, in the manner explained below in reference to FIGS. 16 and 17.

The test for measuring the dispensing force for wipes uses a SINTECH™ Model # M4001 with a MTS 25 pound (11.4 Kg) load cell conventional test machine equipped with TestWorks™ 3.10 software for Windows, or comparable equipment, is used. Both the Sintech™ test machine and TestWorks™ software are available from MTS Corporation located at 1400 Technology Drive, Eden Prairie, Minn. USA. The testing is done, generally, under TAPPI standard procedures and conditions which would be applicable except as otherwise noted. The measurement procedure begins by providing a dispenser with separably joined wipes therein for dispensing. The dispenser is secured to a fixed portion of the test machine (e.g., by hand or otherwise) with the dispensing orifice centered below an upper movable test machine jaws. The wipe to be tested is carefully threaded through the dispenser orifice so that about 1 inch (2.5 cm) of the leading edge of the wipe protrudes through the orifice for securing to the upper movable jaws. The upper jaws are positioned so that the grip area (which is about 4.5 inches by 0.5 inches (11.25 cm by 1.25 cm)) is clamped to the center end portion (about 4 inches by 1 inch (10 cm by 2.5 cm)) of the wipe waiting to be dispensed. The test machine is then activated to move the uppers jaws away from the dispenser (e.g., the upper jaws and/or the dispenser could move relative to the machine) at a speed of about one hundred (100) cm/min until the wipe is completely passed through the dispenser orifice and completely disjointed from the following separably joined wipe. The disjointing of the two wipes may occur from the outside edges in, but could also occur from the inside out, from one side to the other or at one or more points between the sides. The actual tear propagation pattern is not critical, but rather, determining the peak load during test dispensing is the goal. The force in grams (g) as a function of the distance of the jaws movement relative to the machine is recorded using the TestWorks™ 3.10 software. The peak load exhibited during the test is designated as the dispensing force, in grams of force (g), for the wipe. The peak load data for the perforation joint was obtained by measuring the peak load for seven perforation joined sheets in a clip of eight sheets and taking the average of the seven measurements. The peak load data for the adhesive joint was obtained by measuring the peak load for three or four adhesively joined sheets between five clips of eight sheets and taking the average of the four measurements. The dispensing force per unit width or "normalized dispensing force" as used herein, is the dispensing force divided by the width of one sheet along the separably joined edge adjacent the second sheet.

To obtain the dispensing force data for the table, the identified samples were dispensed from three different dispensers, following the above test procedure. Type 1 was that known as currently available PAMPERS® One-Ups!™ of the Procter & Gamble Company of Cincinnati, Ohio 45202, USA. Type 2 was that seen in FIG. 1 (i.e., the shown flexible orifice but with the container like that seen in FIG. 2) of a U.S. Patent application filed separately but concurrently herewith entitled, "FLEXIBLE ORIFICE FOR WET WIPES DISPENSER" of inventors Yung H. Huang et al., U.S. Ser. No. 09/870,785 filed May 31, 2001, assigned to the same assignee of this application, which application is incorporated fully herein by reference. Type 3 was that seen in FIG. 2 of the just cited U.S. Patent application filed separately but concurrently herewith entitled, "FLEXIBLE ORIFICE FOR WET WIPES DISPENSER" of inventors Yung H. Huang et al.

Figures 14A, 14B, 15A, 15B:
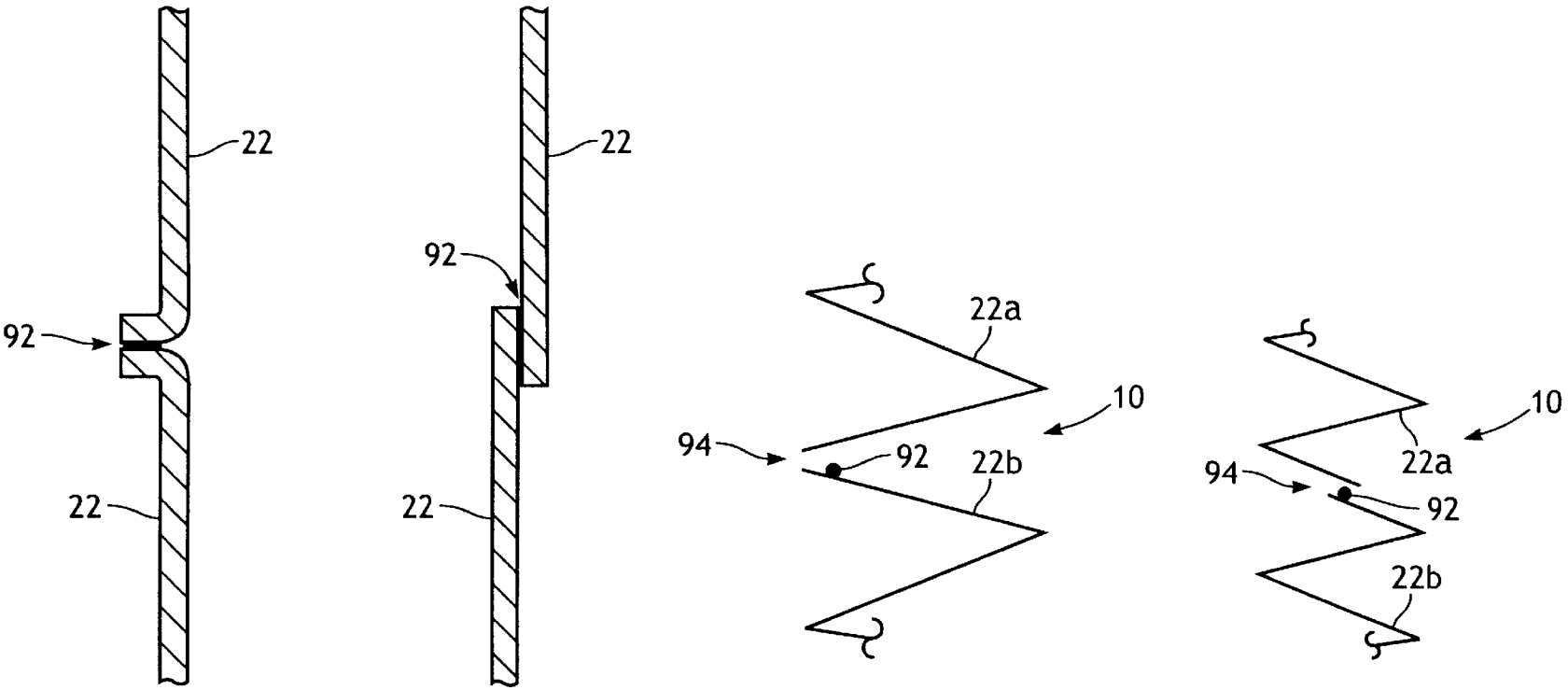
FIG. 14A representatively shows a schematic side view for wipes about to be adhesively joined together, in accordance with the present invention.
FIG. 14B representatively shows a partial cross sectional expanded side view of the wipes of FIG. 14A, now adhesively joined together and in a position separating one wipe from the other.
FIG. 15A representatively shows a schematic side view of wipes about to be adhesively joined together, in accordance with the present invention.
FIG. 15B representatively shows a partial cross sectional expanded side view of the wipes of FIG. 15A, now adhesively joined together and in a position separating one wipe from the other.
Figure 17:
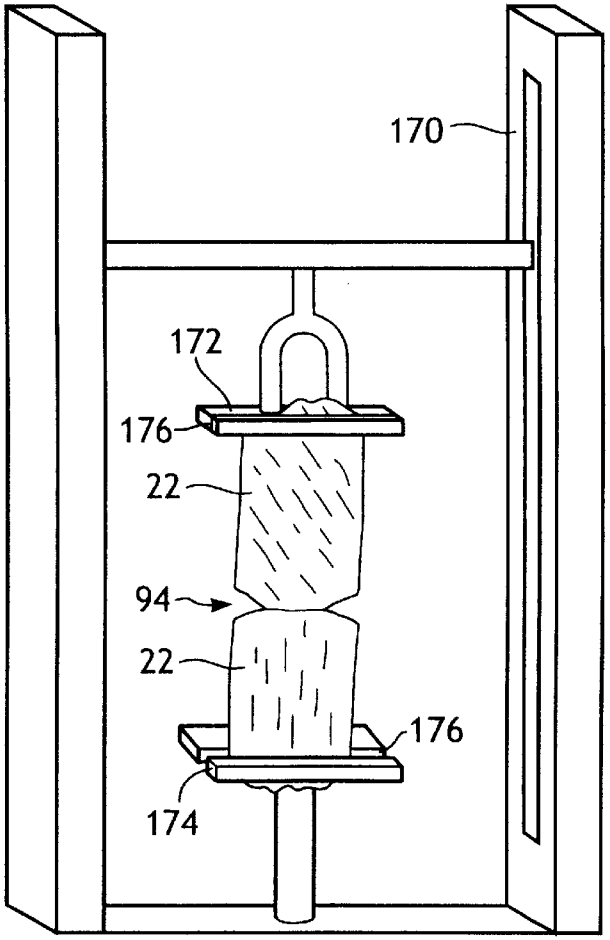
FIG. 17 representatively shows a perspective view of the test machine and wipes of FIG. 16 while the machine is activated and as the wipes become partially disjointed from each other.
Figure 16:
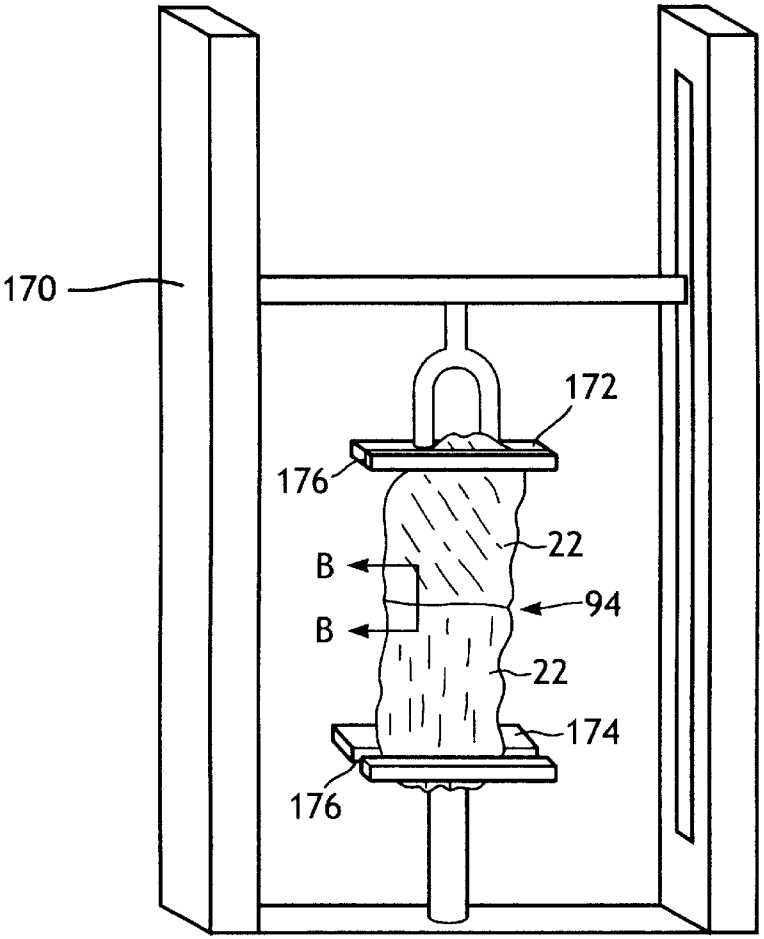
FIG. 16 representatively shows a perspective view of a test machine with the two wipes of FIG. 14A or 15A positioned therein before the machine is activated.

FIGS. 16 and 17 (with reference to FIGS. 3A and 4A for weakened line joint 94 and to FIGS. 14A to 15B inclusive which specifically show two possible adhesively joined configurations), illustrate the test for measuring the detach for two separably joined wipes. FIGS. 16 and 17 specifically show two adhesively joined sheets being separated, and though not shown two perforation joined sheets would be similar except as noted below. The testing is done, generally, under TAPPI standard procedures and conditions which would be applicable except as otherwise noted. A SINTECH™ Model # M4001 with a MTS 25 pound (11.4 Kg) load cell conventional test machine 170 equipped with TestWorks™ 3.10 software for Windows, or comparable equipment, is used. Both the Sintech™ test machine 170 and TestWorks™ software are available from MTS Corporation located at 1400 Technology Drive, Eden Prairie, Minn. USA. The measurement procedure begins by providing two separably joined wipes, e.g., carefully removing two adhesively joined wipes or two perforation joined wipes from a stack of wipes without materially disrupting the joint between the two wipes. Next, the distance between two jaws 172, 174 of machine 170 are set about two inches (5 cm) shorter than the end to end distance (perpendicular to the joint 94) of the wipes 22. For two adhesively joined wipes as in FIGS. 14A and 15A, the joint is seen as 94. For two perforation joined wipes as seen in FIGS. 3A and 4A, the joint is seen as line 24. Grip area 176 of each jaw is about 4.5 inches by 0.5 inches (11.25 cm by 1.25 cm). For two adhesively joined sheets, the non-joint center end portion (about 4 inches by 1 inch (10 cm by 2.5 cm)) of one wipe is clamped to upper jaw 172 while the non-joint center end portion (about 4 inches by 1 inch (10 cm by 2.5 cm)) of the adjoining wipe is clamped to lower jaw 174. For two perforation joined sheets, they are first folded in half along the axis perpendicular to the perforation joint, and then they are placed in jaws 172 and 174 similar to that for adhesively joined sheets. The initial distance between jaws is about 6 inches (15 cm), but this can vary depending on sheet size. The perforation line is about centered between the upper and lower jaws. Machine 170 is then activated to move the jaws away from each other, e.g., one or both jaws moving relative to the machine, at a speed of about one-hundred (100) cm/min until the joint between the two wipes completely breaks and the two once separably joined wipes are completely disjointed from each other. The disjointing of the two wipes may occur as seen in FIG. 17, e.g., from the outside edges in, but could also occur from the inside out, from one side to the other or at one or more points between the sides. The actual tear propagation pattern is not critical, but rather, determining the peak load during testing is the goal. The force in grams (g) as a function of the distance of the jaws movement relative to the machine is recorded using the TestWorks™ 3.10 software. The peak load exhibited during the test is designated as the detach force, in grams of force (g), between two separably joined wipes. The detach force per unit width or "normalized detach force" as used herein, is the detach force divided by the width of one sheet along the separably joined edge adjacent the second sheet.

As a result of their work, and samples representatively seen in the Table, the inventors have determined that particular force relationships between the plurality of sheets 22, as well as between clips 20, are better than others for overcoming some challenges to successively dispensing wipes one at a time more successfully. Such can be beneficial to, e.g., easier wipe retrieval, reducing the likelihood of wipe fallback into the container and/or reducing the likelihood of multiple wipes dispensing when only a single wipe is desired, and the balancing/interaction of these features. For example, the inventors have discovered that the separably joined relationship between adjacent weakened line joined sheets can use a normalized detach force in the range of, and in order of increasing advantage: about 5.3 g/cm to about 42.7 g/cm, about 8 g/cm to about 32 g/cm, about 10.7 g/cm to about 24 g/cm, or about 16 g/cm to about 21.3 g/cm. For similar reasons, the inventors have discovered that the separably joined relationship between adjacent sheets that are adhesively joined can use a normalized detach force for the adhesively joined sheets that is in the range of, and in order of increasing advantage: equal to or less than the normalized detach force for weakened line joined sheets, 30% to 90% of the normalized detach force for weakened line joined sheets, or 40% to 70% of the normalized detach force for weakened line joined sheets. The actual desired normalized detach force for adhesively joined sheets is dependent upon the weakened line characteristics (e.g., detach force) and dispenser and/or dispensing characteristics. For still similar reasons, the inventors have discovered that while the detach force for different types of separably joined relationships can vary, and may advantageously vary depending on various factors above, for dispensing of sheets with such relationships the two different separably joined relationships will advantageously be dispensed using dispensing forces which vary by no more than, in reference to the larger force, and in order of increasing advantage: about 35%, about 20%, about 10%, or about 0%. Still further, the inventors have discovered that the dispensing force employed to dispense a wipe from a stack of wipes including at least two separably joined sheets having different separably joined relationships, will be in the range of, and in order of increasing advantage: about 3.2 g/cm to about 37.3 g/cm, about 5.3 g/cm to about 32 g/cm, about 8 g/cm to about 26.7 g/cm, or about 10.7 g/cm to about 21.3 g/cm, all for a normalized dispensing force between the separably joined wipes. As concerns the relationship of the dispensing force to the detach force for the perforation joined sheets, one can employ a dispensing force that is less than or equal to the detach force necessary to break the perforations. As concerns the relationship of the dispensing force to the detach force for the adhesively joined sheets, one can employ a dispensing force that can be equal to, less than or greater than the detach force necessary to break the perforations, all dependent upon basesheet characteristics and the type of separably joined relationship between adjacent sheets.

When comparing the dispensing force to the detach force, one needs to understand that the detach force is not dependent upon dispensing characteristics. That is, the detach force is dependent merely upon basesheet characteristics (e.g., fiber composition, formation process, bulk, density, thickness, weight, CD tensile, MD tensile) and the perforation configuration. Differently, the dispensing force is dependent upon not only basesheet characteristics (e.g., fiber composition, formation process, bulk, density, thickness, weight, CD tensile, MD tensile) and the perforation configuration, but also dispensing characteristics (e.g., type of dispensing, type of dispenser, wet or dry dispensing).

Without being limited to a theory of operation, the inventors believe they may understand why perforation joined sheets and adhesively joined sheets can have different detach forces and yet can advantageously have similar dispensing forces. For example, as a wipe passes through the dispenser orifice, if it is a weakened line separably joined wipe (e.g., by perforations) it begins to become disjointed from the following wipe discontinuously, i.e., a few perforations at a time until eventually all of the perforations are broken and the first wipe is completely disjointed from the second wipe and fully dispensed from the dispenser. Differently, if the wipe is separably joined to a following wipe by an adhesive joint, it tends to become disjointed from the following wipe continuously, i.e., the entire adhesive joint becomes completely disjointed from the second wipe at about the same time, and it is then fully dispensed from the dispenser. Thus, considering a graphical representation of force as a measure of time, the force curve for the perforation relationship will not experience as great a peak force during dispensing and instead it will be a more smoothed out curve distributing the force over a greater time period. Oppositely, the force curve for the adhesive relationship will experience a greater peak force during dispensing and it will be a shorter curve concentrating more force over a shorter time period. In summary, the inventors have determined that, in one aspect of the invention, providing wipes which enable a more uniform dispensing force to be used regardless of the separably joined relationship between multiple wipes in a clip or stack of wipes is desirable for improved pop-up dispensing.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

We claim:

1. A process for dispensing a stack of fan folded material from a dispenser comprising:

pulling a first sheet of the material through an opening of the dispenser;

separating the first sheet from a subsequent adjacent second sheet of the material at a weakened line between the first and second sheets;

pulling a subsequent third sheet of the material through the opening of the dispenser; and separating the subsequent third sheet of the material from a subsequent adjacent fourth sheet of the material at a separably joined interface between the third and fourth sheets wherein the separably joined interface between the third and fourth sheets is a different type of separably joined interface from the weakened line between the first and second sheets.

2. The process of claim 1 wherein the material comprises wet wipes and the separating the first sheet step and the separating the subsequent third sheet step comprise using a normalized dispensing force in the range of about 3.2 g/cm to about 37.3 g/cm.

3. The process of claim 1 wherein the material comprises wet wipes and the separating the first sheet step and the separating the subsequent third sheet step comprise using a normalized dispensing force in the range of about 5.3 g/cm to about 32 g/cm.

4. The process of claim 1 wherein the material comprises wet wipes and the separating the first sheet step and the separating the subsequent third sheet step comprise using a normalized dispensing force in the range of about 8.0 g/cm to about 26.7 g/cm.

5. The process of claim 1 wherein the material comprises wet wipes and the separating the first sheet step and the separating the subsequent third sheet step comprise using a normalized dispensing force in the range of about 10.7 g/cm to about 21.3 g/cm.

6. The process of claim 1 comprising using a dispensing force which may differ between the separating steps by no more than about 35%.

7. The process of claim 1 comprising using a dispensing force which may differ between the separating steps by no more than about 20%.

8. The process of claim 1 comprising using a dispensing force which may differ between the separating steps by no more than about 10%.

9. The process of claim 1 comprising using a dispensing force which may differ between the separating steps by no more than about 0%.

10. The process of claim 1 wherein separating the first sheet step comprises tearing perforations at the weakened line between the first and second sheets.

11. The process of claim 1 wherein separating the first sheet step comprises separating along a machine direction of the sheet at the weakened line.

12. The process of claim 1 wherein all the pulling and separating steps comprise pulling and separating sheets wetted with a liquid at an add-on rate of about 25 to about 600 weight percent based on a dry weight of the stack of fan folded material.

13. A process for dispensing a stack of fan folded material from a dispenser comprising:

pulling a first sheet of the material through an opening of the dispenser;

separating the first sheet from a subsequent adjacent second sheet of the material at a first type of separably joined interface between the first and second sheets;

pulling a subsequent third sheet of the material through the opening of the dispenser; and separating the subsequent third sheet of the material from a subsequent adjacent fourth sheet of the material at a second type of separably joined interface between the third and fourth sheets wherein the second type of separably joined interface is a different type of separably joined interface from the first type of separably joined interface.

14. The process of claim 13 wherein the separating the first sheet step comprises separating the first type of separably joined interface at a member from the group consisting of perforations and adhesive.

15. The process of claim 13 further comprising forming the first type of separably joined interface in a machine direction of the sheets.

16. The process of claim 13 further comprising forming fold lines in the plurality of fan folded sheets in a machine direction of the sheets.

17. The process of claim 13 further comprising adding a liquid in combination with the stack of fan folded material, the liquid at an add-on rate of about 25 to about 600 weight percent based on a dry weight of the stack of fan folded material.

* * * * *